US011030965B2

(12) United States Patent
Telfer et al.

(10) Patent No.: US 11,030,965 B2
(45) Date of Patent: Jun. 8, 2021

(54) DRIVERS PROVIDING DC-BALANCED REFRESH SEQUENCES FOR COLOR ELECTROPHORETIC DISPLAYS

(71) Applicant: E Ink Corporation, Billerica, MA (US)

(72) Inventors: Stephen J. Telfer, Arlington, MA (US); Christopher L. Hoogeboom, Burlington, MA (US); Kenneth R. Crounse, Somerville, MA (US)

(73) Assignee: E Ink Corporation, Billerica, MA (US)

( * ) Notice: Subject to any disclaimer, the term of this patent is extended or adjusted under 35 U.S.C. 154(b) by 0 days.

(21) Appl. No.: 16/793,766

(22) Filed: Feb. 18, 2020

(65) Prior Publication Data

US 2020/0184907 A1 Jun. 11, 2020

Related U.S. Application Data

(60) Division of application No. 15/916,449, filed on Mar. 9, 2018, now Pat. No. 10,593,272, which is a continuation-in-part of application No. 15/454,276, filed on Mar. 9, 2017, now Pat. No. 10,276,109.

(60) Provisional application No. 62/509,512, filed on May 22, 2017, provisional application No. 62/305,833, filed on Mar. 9, 2016.

(51) Int. Cl.
*G09G 3/34* (2006.01)

(52) U.S. Cl.
CPC ..... *G09G 3/344* (2013.01); *G09G 2300/08* (2013.01); *G09G 2310/0256* (2013.01); *G09G 2310/061* (2013.01); *G09G 2310/068* (2013.01); *G09G 2320/0204* (2013.01)

(58) Field of Classification Search
CPC ..... G09G 3/344; G09G 2300/08; G09G 2310/0256; G09G 2310/061; G09G 2310/038; G09G 2320/0204
See application file for complete search history.

(56) References Cited

U.S. PATENT DOCUMENTS

| | | | |
|---|---|---|---|
| 4,418,346 | A | 11/1983 | Batchelder |
| 5,872,552 | A | 2/1999 | Gordon, II et al. |
| 5,930,026 | A | 7/1999 | Jacobson et al. |
| 6,017,584 | A | 1/2000 | Albert et al. |
| 6,130,774 | A | 10/2000 | Albert et al. |
| 6,144,361 | A | 11/2000 | Gordon, II et al. |
| 6,172,798 | B1 | 1/2001 | Albert et al. |
| 6,184,856 | B1 | 2/2001 | Gordon, II et al. |

(Continued)

OTHER PUBLICATIONS

Kitamura, T. et al., "Electrical toner movement for electronic paper-like display", Asia Display/IDW '01, pp. 1517-1520, Paper HCS1-1 (2001).

(Continued)

*Primary Examiner* — Liliana Cerullo
(74) *Attorney, Agent, or Firm* — Brian D. Bean

(57) ABSTRACT

A method for driving an electro-optic display having a front electrode, a backplane, and a display medium including at least three differently-colored particles, wherein the medium is positioned between the front electrode and the backplane. The method includes applying a reset phase and a color transition phase to the display such that the sum of all impulses results in an offset that maintains a DC-balance across the display medium. The invention additionally includes controllers for executing the method.

15 Claims, 10 Drawing Sheets

(56) References Cited

U.S. PATENT DOCUMENTS 6,225,971 B1 5/2001 Gordon, II et al.
6,241,921 B1 6/2001 Jacobson et al.
6,271,823 B1 8/2001 Gordon, II et al.
6,445,489 B1 9/2002 Jacobson et al.
6,504,524 B1 1/2003 Gates et al.
6,512,354 B2 1/2003 Jacobson et al.
6,531,997 B1 3/2003 Gates et al.
6,545,797 B2 4/2003 Chen et al.
6,664,944 B1 12/2003 Albert et al.
6,672,921 B1 1/2004 Liang et al.
6,727,873 B2 4/2004 Gordon, II et al.
6,753,999 B2 6/2004 Zehner et al.
6,788,449 B2 9/2004 Liang et al.
6,788,452 B2 9/2004 Liang et al.
6,825,970 B2 11/2004 Goenaga et al.
6,864,875 B2 3/2005 Drzaic et al.
6,866,760 B2 3/2005 Paolini, Jr. et al.
6,900,851 B2 5/2005 Morrison et al.
6,914,714 B2 7/2005 Chen et al.
6,922,276 B2 7/2005 Zhang et al.
6,950,220 B2 9/2005 Abramson et al.
6,972,893 B2 12/2005 Chen et al.
6,982,178 B2 1/2006 LeCain et al.
6,995,550 B2 2/2006 Jacobson et al.
7,002,728 B2 2/2006 Pullen et al.
7,012,600 B2 3/2006 Zehner et al.
7,023,420 B2 4/2006 Comiskey et al.
7,034,783 B2 4/2006 Gates et al.
7,038,656 B2 5/2006 Liang et al.
7,038,670 B2 5/2006 Liang et al.
7,046,228 B2 5/2006 Liang et al.
7,052,571 B2 5/2006 Wang et al.
7,061,166 B2 6/2006 Kuniyasu
7,061,662 B2 6/2006 Chung et al.
7,072,095 B2 7/2006 Liang et al.
7,075,502 B1 7/2006 Drzaic et al.
7,116,318 B2 10/2006 Amundson et al.
7,116,466 B2 10/2006 Whitesides et al.
7,119,772 B2 10/2006 Amundson et al.
7,144,942 B2 12/2006 Zang et al.
7,167,155 B1 1/2007 Albert et al.
7,170,670 B2 1/2007 Webber
7,176,880 B2 2/2007 Amundson et al.
7,177,066 B2 2/2007 Chung et al.
7,193,625 B2 3/2007 Danner et al.
7,202,847 B2 4/2007 Gates
7,236,291 B2 6/2007 Kaga et al.
7,242,514 B2 7/2007 Chung et al.
7,259,744 B2 8/2007 Arango et al.
7,304,787 B2 12/2007 Whitesides et al.
7,312,784 B2 12/2007 Baucom et al.
7,312,794 B2 12/2007 Zehner et al.
7,321,459 B2 1/2008 Masuda et al.
7,327,511 B2 2/2008 Whitesides et al.
7,339,715 B2 3/2008 Webber et al.
7,385,751 B2 6/2008 Chen et al.
7,408,699 B2 8/2008 Wang et al.
7,411,719 B2 8/2008 Paolini, Jr. et al.
7,420,549 B2 9/2008 Jacobson et al.
7,432,839 B2 10/2008 Christ
7,453,445 B2 11/2008 Amundson
7,492,339 B2 2/2009 Amundson
7,492,505 B2 2/2009 Liang et al.
7,499,211 B2 3/2009 Suwabe et al.
7,528,822 B2 5/2009 Amundson et al.
7,535,624 B2 5/2009 Amundson et al.
7,545,358 B2 6/2009 Gates et al.
7,583,251 B2 9/2009 Arango et al.
7,602,374 B2 10/2009 Zehner et al.
7,612,760 B2 11/2009 Kawai
7,667,684 B2 2/2010 Jacobson et al.
7,679,599 B2 3/2010 Kawai
7,679,813 B2 3/2010 Liang et al.
7,679,814 B2 3/2010 Paolini, Jr. et al.
7,683,606 B2 3/2010 Kang et al.
7,684,108 B2 3/2010 Wang et al.
7,688,297 B2 3/2010 Zehner et al.
7,715,088 B2 5/2010 Liang et al.
7,729,039 B2 6/2010 LeCain et al.
7,733,311 B2 6/2010 Amundson et al.
7,733,335 B2 6/2010 Zehner et al.
7,787,169 B2 8/2010 Abramson et al.
7,791,789 B2 9/2010 Albert et al.
7,800,813 B2 9/2010 Wu et al.
7,821,702 B2 10/2010 Liang et al.
7,839,564 B2 11/2010 Whitesides et al.
7,848,009 B2 12/2010 Machida et al.
7,859,742 B1 12/2010 Chiu et al.
7,868,869 B2 1/2011 Shin et al.
7,885,457 B2 2/2011 Hirano et al.
7,910,175 B2 3/2011 Webber
7,952,557 B2 5/2011 Amundson et al.
7,952,790 B2 5/2011 Honeyman et al.
7,956,841 B2 6/2011 Albert et al.
7,982,479 B2 7/2011 Wang et al.
7,982,941 B2 7/2011 Lin et al.
7,999,787 B2 8/2011 Amundson et al.
8,009,348 B2 8/2011 Zehner et al.
8,023,176 B2 9/2011 Akashi et al.
8,031,392 B2 10/2011 Hiji et al.
8,040,594 B2 10/2011 Paolini, Jr. et al.
8,054,526 B2 11/2011 Bouchard
8,077,141 B2 12/2011 Duthaler et al.
8,098,418 B2 1/2012 Paolini, Jr. et al.
8,125,501 B2 2/2012 Amundson et al.
8,139,050 B2 3/2012 Jacobson et al.
8,159,636 B2 4/2012 Sun et al.
8,174,490 B2 5/2012 Whitesides et al.
8,174,491 B2 5/2012 Machida et al.
8,213,076 B2 7/2012 Albert et al.
8,243,013 B1 8/2012 Sprague et al.
8,274,472 B1 9/2012 Wang et al.
8,289,250 B2 10/2012 Zehner et al.
8,300,006 B2 10/2012 Zhou et al.
8,305,341 B2 11/2012 Arango et al.
8,314,784 B2 11/2012 Ohkami et al.
8,319,759 B2 11/2012 Jacobson et al.
8,350,803 B2 1/2013 Johnson
8,363,299 B2 1/2013 Paolini, Jr. et al.
8,373,649 B2 2/2013 Low et al.
8,384,658 B2 2/2013 Albert et al.
8,422,116 B2 4/2013 Sprague et al.
8,432,387 B2 4/2013 Lee
8,441,714 B2 5/2013 Paolini, Jr. et al.
8,441,716 B2 5/2013 Paolini, Jr. et al.
8,456,414 B2 6/2013 Lin et al.
8,462,102 B2 6/2013 Wong et al.
8,466,852 B2 6/2013 Drzaic et al.
8,503,063 B2 8/2013 Sprague
8,514,168 B2 8/2013 Chung et al.
8,537,105 B2 9/2013 Chiu et al.
8,542,431 B2 9/2013 Shuto et al.
8,558,783 B2 10/2013 Wilcox et al.
8,558,785 B2 10/2013 Zehner et al.
8,558,786 B2 10/2013 Lin
8,558,855 B2 10/2013 Sprague et al.
8,576,164 B2 11/2013 Sprague et al.
8,576,259 B2 11/2013 Lin et al.
8,576,470 B2 11/2013 Paolini, Jr. et al.
8,576,475 B2 11/2013 Huang et al.
8,576,476 B2 11/2013 Telfer et al.
8,587,859 B2 11/2013 Kayashima et al.
8,593,396 B2 11/2013 Amundson et al.
8,593,721 B2 11/2013 Albert et al.
8,605,032 B2 12/2013 Liu et al.
8,605,354 B2 12/2013 Zhang et al.
8,629,832 B2 1/2014 Tanabe
8,643,595 B2 2/2014 Chung et al.
8,649,084 B2 2/2014 Wang et al.
8,665,206 B2 3/2014 Lin et al.
8,670,174 B2 3/2014 Sprague et al.
8,681,191 B2 3/2014 Yang et al.
8,704,754 B2 4/2014 Machida et al.
8,704,756 B2 4/2014 Lin

(56) References Cited

U.S. PATENT DOCUMENTS 8,717,664 B2 5/2014 Wang et al.
8,730,153 B2 5/2014 Sprague et al.
8,730,216 B2 5/2014 Mizutani et al.
8,730,559 B2 5/2014 Akashi et al.
8,780,103 B2 7/2014 van Veenendaal et al.
8,786,935 B2 7/2014 Sprague
8,797,634 B2 8/2014 Paolini, Jr. et al.
8,810,525 B2 8/2014 Sprague
8,810,899 B2 8/2014 Sprague et al.
8,830,559 B2 9/2014 Honeyman et al.
8,873,129 B2 10/2014 Paolini, Jr. et al.
8,902,153 B2 12/2014 Bouchard et al.
8,902,491 B2 12/2014 Wang et al.
8,917,439 B2 12/2014 Wang et al.
8,928,562 B2 1/2015 Gates et al.
8,928,641 B2 1/2015 Chiu et al.
8,964,282 B2 2/2015 Wang et al.
8,976,444 B2 3/2015 Zhang et al.
9,013,383 B2 4/2015 Hough
9,013,394 B2 4/2015 Lin
9,013,783 B2 4/2015 Sprague
9,019,197 B2 4/2015 Lin
9,019,198 B2 4/2015 Lin et al.
9,019,318 B2 4/2015 Sprague et al.
9,082,352 B2 7/2015 Cheng et al.
9,116,412 B2 8/2015 Lin
9,146,439 B2 9/2015 Zhang
9,152,005 B2 10/2015 Morikawa et al.
9,164,207 B2 10/2015 Honeyman et al.
9,170,467 B2 10/2015 Whitesides et al.
9,170,468 B2 10/2015 Lin et al.
9,171,508 B2 10/2015 Sprague et al.
9,183,793 B2 10/2015 Murayama
9,182,646 B2 11/2015 Paolini, Jr. et al.
9,182,850 B2 11/2015 Lin et al.
9,183,792 B2 11/2015 Henzen et al.
9,195,111 B2 11/2015 Anseth et al.
9,199,441 B2 12/2015 Danner
9,218,773 B2 12/2015 Sun et al.
9,224,338 B2 12/2015 Chan et al.
9,224,342 B2 12/2015 Sprague et al.
9,224,344 B2 12/2015 Chung et al.
9,230,492 B2 1/2016 Harrington et al.
9,251,736 B2 2/2016 Lin et al.
9,262,973 B2 2/2016 Wu et al.
9,268,191 B2 2/2016 Paolini, Jr.
9,269,311 B2 2/2016 Amundson
9,279,906 B2 3/2016 Kang
9,285,649 B2 3/2016 Du et al.
9,293,511 B2 3/2016 Jacobson et al.
9,299,294 B2 3/2016 Lin et al.
9,318,095 B2 4/2016 Obata et al.
9,341,916 B2 5/2016 Telfer et al.
9,348,193 B2 5/2016 Hiji et al.
9,360,733 B2 6/2016 Wang et al.
9,361,836 B1 6/2016 Telfer et al.
9,373,289 B2 6/2016 Sprague et al.
9,383,623 B2 7/2016 Lin et al.
9,390,066 B2 7/2016 Smith et al.
9,390,661 B2 7/2016 Chiu et al.
9,412,314 B2 8/2016 Amundson et al.
9,423,666 B2 8/2016 Wang et al.
9,429,810 B2 8/2016 Kaino et al.
9,459,510 B2 10/2016 Lin
9,460,666 B2 10/2016 Sprague et al.
9,495,918 B2 11/2016 Harrington et al.
9,501,981 B2 11/2016 Lin et al.
9,513,527 B2 12/2016 Chan et al.
9,513,743 B2 12/2016 Sjodin et al.
9,514,667 B2 12/2016 Lin
9,541,813 B2 1/2017 Sakamoto et al.
9,541,814 B2 1/2017 Lin et al.
9,542,895 B2 1/2017 Gates et al.
9,564,088 B2 2/2017 Wilcox et al.
9,612,502 B2 4/2017 Danner et al.
9,620,048 B2 4/2017 Sim et al.
9,620,067 B2 4/2017 Harrington et al.
9,671,668 B2 6/2017 Chan et al.
9,672,766 B2 6/2017 Sjodin
9,691,333 B2 6/2017 Cheng et al.
9,697,778 B2 7/2017 Telfer et al.
9,721,495 B2 8/2017 Harrington et al.
9,740,076 B2 8/2017 Paolini et al.
9,759,980 B2 9/2017 Du et al.
9,792,861 B2 10/2017 Chang et al.
9,792,862 B2 10/2017 Hung et al.
9,805,668 B2 10/2017 Agostinelli et al.
9,812,073 B2 11/2017 Lin et al.
9,921,451 B2 3/2018 Telfer et al.
9,966,018 B2 5/2018 Gates et al.
10,031,394 B2 7/2018 Nakayama et al.
10,162,242 B2 12/2018 Wang et al.
10,209,556 B2 2/2019 Rosenfeld et al.
10,229,641 B2 3/2019 Yang et al.
10,319,313 B2 6/2019 Harris et al.
10,444,553 B2 10/2019 Laxton
2003/0102858 A1 6/2003 Jacobson et al.
2004/0246562 A1 12/2004 Chung et al.
2005/0001812 A1* 1/2005 Amundson ..... G09G 3/2011 345/107
2005/0253777 A1 11/2005 Zehner et al.
2006/0077190 A1 4/2006 Zhou et al.
2007/0091418 A1 4/2007 Danner et al.
2007/0103427 A1 5/2007 Zhou et al.
2007/0176912 A1 8/2007 Beames et al.
2008/0024429 A1 1/2008 Zehner
2008/0024482 A1 1/2008 Gates et al.
2008/0043318 A1 2/2008 Whitesides et al.
2008/0048970 A1 2/2008 Drzaic et al.
2008/0094314 A1 4/2008 Huitema et al.
2008/0136774 A1 6/2008 Harris et al.
2008/0204399 A1 8/2008 Choi et al.
2008/0303780 A1 12/2008 Sprague et al.
2009/0174651 A1 7/2009 Jacobson et al.
2009/0225398 A1 9/2009 Duthaler et al.
2009/0322721 A1 12/2009 Zehner et al.
2010/0060628 A1 3/2010 Lenssen et al.
2010/0156780 A1 6/2010 Jacobson et al.
2010/0194733 A1 8/2010 Lin et al.
2010/0194789 A1 8/2010 Lin et al.
2010/0220121 A1 9/2010 Zehner et al.
2010/0265561 A1 10/2010 Gates et al.
2011/0043543 A1 2/2011 Chen et al.
2011/0063314 A1 3/2011 Chiu et al.
2011/0175875 A1 7/2011 Lin et al.
2011/0175939 A1 7/2011 Moriyama et al.
2011/0193840 A1 8/2011 Amundson et al.
2011/0193841 A1 8/2011 Amundson et al.
2011/0199671 A1 8/2011 Amundson et al.
2011/0221740 A1 9/2011 Yang et al.
2012/0001957 A1 1/2012 Liu et al.
2012/0098740 A1 4/2012 Chiu et al.
2012/0293858 A1 11/2012 Telfer et al.
2012/0326957 A1 12/2012 Drzaic et al.
2013/0063333 A1 3/2013 Arango et al.
2013/0194250 A1 8/2013 Amundson et al.
2013/0222884 A1 8/2013 Moriyama et al.
2013/0222886 A1 8/2013 Kawahara et al.
2013/0222888 A1 8/2013 Urano et al.
2013/0242378 A1 9/2013 Paolini, Jr. et al.
2013/0278995 A1 10/2013 Drzaic et al.
2014/0009817 A1 1/2014 Wilcox et al.
2014/0055840 A1 2/2014 Zang et al.
2014/0078576 A1 3/2014 Sprague
2014/0204012 A1 7/2014 Wu et al.
2014/0240210 A1 8/2014 Wu et al.
2014/0253425 A1 9/2014 Zalesky et al.
2014/0266998 A1 9/2014 Ogawa et al.
2014/0293398 A1 10/2014 Wang et al.
2014/0362213 A1 12/2014 Tseng
2015/0005720 A1 1/2015 Zang
2015/0097877 A1 4/2015 Lin et al.
2015/0118390 A1 4/2015 Rosenfeld et al.
2015/0262255 A1 9/2015 Khajehnouri et al.

(56) References Cited

U.S. PATENT DOCUMENTS

| | | | |
|---|---|---|---|
| 2015/0262551 | A1 | 9/2015 | Zehner et al. |
| 2015/0268531 | A1 | 9/2015 | Wang et al. |
| 2015/0301246 | A1 | 10/2015 | Zang et al. |
| 2016/0012710 | A1 | 1/2016 | Lu et al. |
| 2016/0026062 | A1 | 1/2016 | Zhang |
| 2016/0048054 | A1 | 2/2016 | Danner |
| 2016/0140910 | A1 | 5/2016 | Amundson |
| 2016/0180777 | A1 | 6/2016 | Lin et al. |

OTHER PUBLICATIONS

Yamaguchi, Y. et al., "Toner display using insulative particles charged triboelectrically", Asia Display/IDW '01, pp. 1729-1730, Paper AMD4-4 (2001).

Heikenfeld, J. et al., "A critical review of the present and future prospects for electronic paper", SID, 19(2), pp. 129-156 (2011).

Korean Intellectual Property Office, PCT/US2018/021671, International Search Report and Written Opinion, dated Jun. 21, 2018.

* cited by examiner

| | | | | | | | |
|---|---|---|---|---|---|---|---|
| | | | | | | | Cyan |
| | | Magenta | | Cyan | | Yellow | Magenta |
| | Yellow | Yellow | Magenta | Magenta | Cyan | Cyan | Yellow |
| **White** | **White** | **White** | **White** | **White** | **White** | **White** | **White** |
| Cyan | Cyan | Cyan | Cyan | Yellow | Magenta | Magenta | |
| Magenta | Magenta | | Yellow | | Yellow | | |
| Yellow | | | | | | | |
| **White** | **Yellow** | **Red** | **Magenta** | **Blue** | **Cyan** | **Green** | **Black** |
| [A] | [B] | [C] | [D] | [E] | [F] | [G] | [H] |

FIG. 2

DRIVERS PROVIDING DC-BALANCED REFRESH SEQUENCES FOR COLOR ELECTROPHORETIC DISPLAYS

RELATED APPLICATIONS

This application is a divisional of U.S. application Ser. No. 15/916,449, filed Mar. 9, 2018, and published as U.S. Patent Publication No. 2018/0197486, which is a continuation-in-part of U.S. application Ser. No. 15/454,276, filed Mar. 9, 2017, now U.S. Pat. No. 10,276,109, which claims the benefit of provisional Application Ser. No. 62/305,833, filed Mar. 9, 2016. This application additionally claims priority to U.S. provisional Application Ser. No. 62/509,512, filed May 22, 2017. The entire contents of the aforementioned applications are herein incorporated by reference.

BACKGROUND OF INVENTION

This invention relates to methods for driving electro-optic displays, especially but not exclusively electrophoretic displays capable of rendering more than two colors using a single layer of electrophoretic material comprising a plurality of colored particles, for example white, cyan, yellow, and magenta particles, wherein two particles are positively-charged and two particles are negatively-charged, and one positively-charged particle and one negatively-charged particle has a thick polymer shell.

The term color as used herein includes black and white. White particles are often of the light scattering type.

The term gray state is used herein in its conventional meaning in the imaging art to refer to a state intermediate two extreme optical states of a pixel, and does not necessarily imply a black-white transition between these two extreme states. For example, several of the E Ink patents and published applications referred to below describe electrophoretic displays in which the extreme states are white and deep blue, so that an intermediate gray state would actually be pale blue. Indeed, as already mentioned, the change in optical state may not be a color change at all. The terms black and white may be used hereinafter to refer to the two extreme optical states of a display, and should be understood as normally including extreme optical states which are not strictly black and white, for example the aforementioned white and dark blue states.

The terms bistable and bistability are used herein in their conventional meaning in the art to refer to displays comprising display elements having first and second display states differing in at least one optical property, and such that after any given element has been driven, by means of an addressing pulse of finite duration, to assume either its first or second display state, after the addressing pulse has terminated, that state will persist for at least several times, for example at least four times, the minimum duration of the addressing pulse required to change the state of the display element. It is shown in U.S. Pat. No. 7,170,670 that some particle-based electrophoretic displays capable of gray scale are stable not only in their extreme black and white states but also in their intermediate gray states, and the same is true of some other types of electro-optic displays. This type of display is properly called multi-stable rather than bistable, although for convenience the term bistable may be used herein to cover both bistable and multi-stable displays.

The term impulse, when used to refer to driving an electrophoretic display, is used herein to refer to the integral of the applied voltage with respect to time during the period in which the display is driven.

A particle that absorbs, scatters, or reflects light, either in a broad band or at selected wavelengths, is referred to herein as a colored or pigment particle. Various materials other than pigments (in the strict sense of that term as meaning insoluble colored materials) that absorb or reflect light, such as dyes or photonic crystals, etc., may also be used in the electrophoretic media and displays of the present invention.

Particle-based electrophoretic displays have been the subject of intense research and development for a number of years. In such displays, a plurality of charged particles (sometimes referred to as pigment particles) move through a fluid under the influence of an electric field. Electrophoretic displays can have attributes of good brightness and contrast, wide viewing angles, state bistability, and low power consumption when compared with liquid crystal displays. Nevertheless, problems with the long-term image quality of these displays have prevented their widespread usage. For example, particles that make up electrophoretic displays tend to settle, resulting in inadequate service-life for these displays.

As noted above, electrophoretic media require the presence of a fluid. In most prior art electrophoretic media, this fluid is a liquid, but electrophoretic media can be produced using gaseous fluids; see, for example, Kitamura, T., et al., Electrical toner movement for electronic paper-like display, IDW Japan, 2001, Paper HCS1-1, and Yamaguchi, Y., et al., Toner display using insulative particles charged triboelectrically, IDW Japan, 2001, Paper AMD4-4). See also U.S. Pat. Nos. 7,321,459 and 7,236,291. Such gas-based electrophoretic media appear to be susceptible to the same types of problems due to particle settling as liquid-based electrophoretic media, when the media are used in an orientation which permits such settling, for example in a sign where the medium is disposed in a vertical plane. Indeed, particle settling appears to be a more serious problem in gas-based electrophoretic media than in liquid-based ones, since the lower viscosity of gaseous suspending fluids as compared with liquid ones allows more rapid settling of the electrophoretic particles.

Numerous patents and applications assigned to or in the names of the Massachusetts Institute of Technology (MIT) and E Ink Corporation describe various technologies used in encapsulated electrophoretic and other electro-optic media. Such encapsulated media comprise numerous small capsules, each of which itself comprises an internal phase containing electrophoretically-mobile particles in a fluid medium, and a capsule wall surrounding the internal phase. Typically, the capsules are themselves held within a polymeric binder to form a coherent layer positioned between two electrodes. The technologies described in these patents and applications include:

(a) Electrophoretic particles, fluids and fluid additives; see for example U.S. Pat. Nos. 7,002,728 and 7,679,814;
(b) Capsules, binders and encapsulation processes; see for example U.S. Pat. Nos. 6,922,276 and 7,411,719;
(c) Microcell structures, wall materials, and methods of forming microcells; see for example U.S. Pat. Nos. 7,072,095 and 9,279,906;
(d) Methods for filling and sealing microcells; see for example U.S. Pat. Nos. 7,144,942 and 7,715,088;
(e) Films and sub-assemblies containing electro-optic materials; see for example U.S. Pat. Nos. 6,982,178 and 7,839,564;
(f) Backplanes, adhesive layers and other auxiliary layers and methods used in displays; see for example U.S. Pat. Nos. 7,116,318 and 7,535,624;

(g) Color formation color adjustment; see for example U.S. Pat. Nos. 6,017,584; 6,545,797; 6,664,944; 6,788,452; 6,864,875; 6,914,714; 6,972,893; 7,038,656; 7,038,670; 7,046,228; 7,052,571; 7,075,502*; 7,167,155; 7,385,751; 7,492,505; 7,667,684; 7,684,108; 7,791,789; 7,800,813; 7,821,702; 7,839,564*; 7,910,175; 7,952,790; 7,956,841; 7,982,941; 8,040,594; 8,054,526; 8,098,418; 8,159,636; 8,213,076; 8,363,299; 8,422,116; 8,441,714; 8,441,716; 8,466,852; 8,503,063; 8,576,470; 8,576,475; 8,593,721; 8,605,354; 8,649,084; 8,670,174; 8,704,756; 8,717,664; 8,786,935; 8,797,634; 8,810,899; 8,830,559; 8,873,129; 8,902,153; 8,902,491; 8,917,439; 8,964,282; 9,013,783; 9,116,412; 9,146,439; 9,164,207; 9,170,467; 9,170,468; 9,182,646; 9,195,111; 9,199,441; 9,268,191; 9,285,649; 9,293,511; 9,341,916; 9,360,733; 9,361,836; 9,383,623; and 9,423,666; and U.S. Patent Applications Publication Nos. 2008/0043318; 2008/0048970; 2009/0225398; 2010/0156780; 2011/0043543; 2012/0326957; 2013/0242378; 2013/0278995; 2014/0055840; 2014/0078576; 2014/0340430; 2014/0340736; 2014/0362213; 2015/0103394; 2015/0118390; 2015/0124345; 2015/0198858; 2015/0234250; 2015/0268531; 2015/0301246; 2016/0011484; 2016/0026062; 2016/0048054; 2016/0116816; 2016/0116818; and 2016/0140909;

(h) Methods for driving displays; see for example U.S. Pat. Nos. 5,930,026; 6,445,489; 6,504,524; 6,512,354; 6,531,997; 6,753,999; 6,825,970; 6,900,851; 6,995,550; 7,012,600; 7,023,420; 7,034,783; 7,061,166; 7,061,662; 7,116,466; 7,119,772; 7,177,066; 7,193,625; 7,202,847; 7,242,514; 7,259,744; 7,304,787; 7,312,794; 7,327,511; 7,408,699; 7,453,445; 7,492,339; 7,528,822; 7,545,358; 7,583,251; 7,602,374; 7,612,760; 7,679,599; 7,679,813; 7,683,606; 7,688,297; 7,729,039; 7,733,311; 7,733,335; 7,787,169; 7,859,742; 7,952,557; 7,956,841; 7,982,479; 7,999,787; 8,077,141; 8,125,501; 8,139,050; 8,174,490; 8,243,013; 8,274,472; 8,289,250; 8,300,006; 8,305,341; 8,314,784; 8,373,649; 8,384,658; 8,456,414; 8,462,102; 8,514,168; 8,537,105; 8,558,783; 8,558,785; 8,558,786; 8,558,855; 8,576,164; 8,576,259; 8,593,396; 8,605,032; 8,643,595; 8,665,206; 8,681,191; 8,730,153; 8,810,525; 8,928,562; 8,928,641; 8,976,444; 9,013,394; 9,019,197; 9,019,198; 9,019,318; 9,082,352; 9,171,508; 9,218,773; 9,224,338; 9,224,342; 9,224,344; 9,230,492; 9,251,736; 9,262,973; 9,269,311; 9,299,294; 9,373,289; 9,390,066; 9,390,661; and 9,412,314; and U.S. Patent Applications Publication Nos. 2003/0102858; 2004/0246562; 2005/0253777; 2007/0091418; 2007/0103427; 2007/0176912; 2008/0024429; 2008/0024482; 2008/0136774; 2008/0291129; 2008/0303780; 2009/0174651; 2009/0195568; 2009/0322721; 2010/0194733; 2010/0194789; 2010/0220121; 2010/0265561; 2010/0283804; 2011/0063314; 2011/0175875; 2011/0193840; 2011/0193841; 2011/0199671; 2011/0221740; 2012/0001957; 2012/0098740; 2013/0063333; 2013/0194250; 2013/0249782; 2013/0321278; 2014/0009817; 2014/0085355; 2014/0204012; 2014/0218277; 2014/0240210; 2014/0240373; 2014/0253425; 2014/0292830; 2014/0293398; 2014/0333685; 2014/0340734; 2015/0070744; 2015/0097877; 2015/0109283; 2015/0213749; 2015/0213765; 2015/0221257; 2015/0262255; 2015/0262551; 2016/0071465; 2016/0078820; 2016/0093253; 2016/0140910; and 2016/0180777 (these patents and applications may hereinafter be referred to as the MEDEOD (MEthods for Driving Electro-optic Displays) applications);

(i) Applications of displays; see for example U.S. Pat. Nos. 7,312,784 and 8,009,348; and (j) Non-electrophoretic displays, as described in U.S. Pat. No. 6,241,921; and U.S. Patent Applications Publication Nos. 2015/0277160; and U.S. Patent Application Publications Nos. 2015/0005720 and 2016/0012710.

Many of the aforementioned patents and applications recognize that the walls surrounding the discrete microcapsules in an encapsulated electrophoretic medium could be replaced by a continuous phase, thus producing a so-called polymer-dispersed electrophoretic display, in which the electrophoretic medium comprises a plurality of discrete droplets of an electrophoretic fluid and a continuous phase of a polymeric material, and that the discrete droplets of electrophoretic fluid within such a polymer-dispersed electrophoretic display may be regarded as capsules or microcapsules even though no discrete capsule membrane is associated with each individual droplet; see for example, U.S. Pat. No. 6,866,760. Accordingly, for purposes of the present application, such polymer-dispersed electrophoretic media are regarded as sub-species of encapsulated electrophoretic media.

A related type of electrophoretic display is a so-called microcell electrophoretic display. In a microcell electrophoretic display, the charged particles and the fluid are not encapsulated within microcapsules but instead are retained within a plurality of cavities formed within a carrier medium, typically a polymeric film. See, for example, U.S. Pat. Nos. 6,672,921 and 6,788,449, both assigned to SiPix Imaging, Inc.

Although electrophoretic media are often opaque (since, for example, in many electrophoretic media, the particles substantially block transmission of visible light through the display) and operate in a reflective mode, many electrophoretic displays can be made to operate in a so-called shutter mode in which one display state is substantially opaque and one is light-transmissive. See, for example, U.S. Pat. Nos. 5,872,552; 6,130,774; 6,144,361; 6,172,798; 6,271,823; 6,225,971; and 6,184,856. Dielectrophoretic displays, which are similar to electrophoretic displays but rely upon variations in electric field strength, can operate in a similar mode; see U.S. Pat. No. 4,418,346. Other types of electro-optic displays may also be capable of operating in shutter mode. Electro-optic media operating in shutter mode can be used in multi-layer structures for full color displays; in such structures, at least one layer adjacent the viewing surface of the display operates in shutter mode to expose or conceal a second layer more distant from the viewing surface.

An encapsulated electrophoretic display typically does not suffer from the clustering and settling failure mode of traditional electrophoretic devices and provides further advantages, such as the ability to print or coat the display on a wide variety of flexible and rigid substrates. (Use of the word printing is intended to include all forms of printing and coating, including, but without limitation: pre-metered coatings such as patch die coating, slot or extrusion coating, slide or cascade coating, curtain coating; roll coating such as knife over roll coating, forward and reverse roll coating; gravure coating; dip coating; spray coating; meniscus coating; spin coating; brush coating; air knife coating; silk screen printing processes; electrostatic printing processes; thermal printing processes; ink jet printing processes; electrophoretic deposition (See U.S. Pat. No. 7,339,715); and other similar techniques.) Thus, the resulting display can be flexible. Further, because the display medium can be printed (using a variety of methods), the display itself can be made inexpensively.

As indicated above most simple prior art electrophoretic media essentially display only two colors. Such electrophoretic media either use a single type of electrophoretic particle having a first color in a colored fluid having a second, different color (in which case, the first color is displayed when the particles lie adjacent the viewing surface of the display and the second color is displayed when the particles are spaced from the viewing surface), or first and second types of electrophoretic particles having differing first and second colors in an uncolored fluid (in which case, the first color is displayed when the first type of particles lie adjacent the viewing surface of the display and the second color is displayed when the second type of particles lie adjacent the viewing surface). Typically the two colors are black and white. If a full color display is desired, a color filter array may be deposited over the viewing surface of the monochrome (black and white) display. Displays with color filter arrays rely on area sharing and color blending to create color stimuli. The available display area is shared between three or four primary colors such as red/green/blue (RGB) or red/green/blue/white (RGBW), and the filters can be arranged in one-dimensional (stripe) or two-dimensional (2×2) repeat patterns. Other choices of primary colors or more than three primaries are also known in the art. The three (in the case of RGB displays) or four (in the case of RGBW displays) sub-pixels are chosen small enough so that at the intended viewing distance they visually blend together to a single pixel with a uniform color stimulus ('color blending'). The inherent disadvantage of area sharing is that the colorants are always present, and colors can only be modulated by switching the corresponding pixels of the underlying monochrome display to white or black (switching the corresponding primary colors on or off). For example, in an ideal RGBW display, each of the red, green, blue and white primaries occupy one fourth of the display area (one sub-pixel out of four), with the white sub-pixel being as bright as the underlying monochrome display white, and each of the colored sub-pixels being no lighter than one third of the monochrome display white. The brightness of the white color shown by the display as a whole cannot be more than one half of the brightness of the white sub-pixel (white areas of the display are produced by displaying the one white sub-pixel out of each four, plus each colored sub-pixel in its colored form being equivalent to one third of a white sub-pixel, so the three colored sub-pixels combined contribute no more than the one white sub-pixel). The brightness and saturation of colors is lowered by area-sharing with color pixels switched to black. Area sharing is especially problematic when mixing yellow because it is lighter than any other color of equal brightness, and saturated yellow is almost as bright as white. Switching the blue pixels (one fourth of the display area) to black makes the yellow too dark.

Multilayer, stacked electrophoretic displays are known in the art; see, for example, J. Heikenfeld, P. Drzaic, J-S Yeo and T. Koch, Journal of the SID, 19(2), 2011, pp. 129-156. In such displays, ambient light passes through images in each of the three subtractive primary colors, in precise analogy with conventional color printing. U.S. Pat. No. 6,727,873 describes a stacked electrophoretic display in which three layers of switchable cells are placed over a reflective background. Similar displays are known in which colored particles are moved laterally (see International Application No. WO 2008/065605) or, using a combination of vertical and lateral motion, sequestered into microcells. In both cases, each layer is provided with electrodes that serve to concentrate or disperse the colored particles on a pixel-by-pixel basis, so that each of the three layers requires a layer of thin-film transistors (TFT's) (two of the three layers of TFT's must be substantially transparent) and a light-transmissive counter-electrode. Such a complex arrangement of electrodes is costly to manufacture, and in the present state of the art it is difficult to provide an adequately transparent plane of pixel electrodes, especially as the white state of the display must be viewed through several layers of electrodes. Multi-layer displays also suffer from parallax problems as the thickness of the display stack approaches or exceeds the pixel size.

U.S. Applications Publication Nos. 2012/0008188 and 2012/0134009 describe multicolor electrophoretic displays having a single back plane comprising independently addressable pixel electrodes and a common, light-transmissive front electrode. Between the back plane and the front electrode is disposed a plurality of electrophoretic layers. Displays described in these applications are capable of rendering any of the primary colors (red, green, blue, cyan, magenta, yellow, white and black) at any pixel location. However, there are disadvantages to the use of multiple electrophoretic layers located between a single set of addressing electrodes. The electric field experienced by the particles in a particular layer is lower than would be the case for a single electrophoretic layer addressed with the same voltage. In addition, optical losses in an electrophoretic layer closest to the viewing surface (for example, caused by light scattering or unwanted absorption) may affect the appearance of images formed in underlying electrophoretic layers.

Attempts have been made to provide full-color electrophoretic displays using a single electrophoretic layer. For example, U.S. Patent Application Publication No. 2013/0208338 describes a color display comprising an electrophoretic fluid which comprises one or two types of pigment particles dispersed in a clear and colorless or colored solvent, the electrophoretic fluid being disposed between a common electrode and a plurality of pixel or driving electrodes. The driving electrodes are arranged to expose a background layer. U.S. Patent Application Publication No. 2014/0177031 describes a method for driving a display cell filled with an electrophoretic fluid comprising two types of charged particles carrying opposite charge polarities and of two contrast colors. The two types of pigment particles are dispersed in a colored solvent or in a solvent with non-charged or slightly charged colored particles dispersed therein. The method comprises driving the display cell to display the color of the solvent or the color of the non-charged or slightly charged colored particles by applying a driving voltage which is about 1 to about 20% of the full driving voltage. U.S. Patent Application Publication No. 2014/0092465 and 2014/0092466 describe an electrophoretic fluid, and a method for driving an electrophoretic display. The fluid comprises first, second and third type of pigment particles, all of which are dispersed in a solvent or solvent mixture. The first and second types of pigment particles carry opposite charge polarities, and the third type of pigment particles has a charge level being less than about 50% of the charge level of the first or second type. The three types of pigment particles have different levels of threshold voltage, or different levels of mobility, or both. None of these patent applications disclose full color display in the sense in which that term is used below.

U.S. Patent Application Publication No. 2007/0031031 describes an image processing device for processing image data in order to display an image on a display medium in which each pixel is capable of displaying white, black and one other color. U.S. Patent Applications Publication Nos. 2008/0151355; 2010/0188732; and 2011/0279885 describe a color display in which mobile particles move through a porous structure. U.S. Patent Applications Publication Nos. 2008/0303779 and 2010/0020384 describe a display medium comprising first, second and third particles of differing colors. The first and second particles can form aggregates, and the smaller third particles can move through apertures left between the aggregated first and second particles. U.S. Patent Application Publication No. 2011/0134506 describes a display device including an electrophoretic display element including plural types of particles enclosed between a pair of substrates, at least one of the substrates being translucent and each of the respective plural types of particles being charged with the same polarity, differing in optical properties, and differing in either in migration speed and/or electric field threshold value for moving, a translucent display-side electrode provided at the substrate side where the translucent substrate is disposed, a first back-side electrode provided at the side of the other substrate, facing the display-side electrode, and a second back-side electrode provided at the side of the other substrate, facing the display-side electrode; and a voltage control section that controls the voltages applied to the display-side electrode, the first back-side electrode, and the second back-side electrode, such that the types of particles having the fastest migration speed from the plural types of particles, or the types of particles having the lowest threshold value from the plural types of particles, are moved, in sequence by each of the different types of particles, to the first back-side electrode or to the second back-side electrode, and then the particles that moved to the first back-side electrode are moved to the display-side electrode. U.S. Patent Applications Publication Nos. 2011/0175939; 2011/0298835; 2012/0327504; and 2012/0139966 describe color displays which rely upon aggregation of multiple particles and threshold voltages. U.S. Patent Application Publication No. 2013/0222884 describes an electrophoretic particle, which contains a colored particle containing a charged group-containing polymer and a coloring agent, and a branched silicone-based polymer being attached to the colored particle and containing, as copolymerization components, a reactive monomer and at least one monomer selected from a specific group of monomers. U.S. Patent Application Publication No. 2013/0222885 describes a dispersion liquid for an electrophoretic display containing a dispersion medium, a colored electrophoretic particle group dispersed in the dispersion medium and migrates in an electric field, a non-electrophoretic particle group which does not migrate and has a color different from that of the electrophoretic particle group, and a compound having a neutral polar group and a hydrophobic group, which is contained in the dispersion medium in a ratio of about 0.01 to about 1 mass % based on the entire dispersion liquid, U.S. Patent Application Publication No. 2013/0222886 describes a dispersion liquid for a display including floating particles containing: core particles including a colorant and a hydrophilic resin; and a shell covering a surface of each of the core particles and containing a hydrophobic resin with a difference in a solubility parameter of 7.95 $(J/cm^3)^{1/2}$ or more. U.S. Patent Applications Publication Nos. 2013/0222887 and 2013/0222888 describe an electrophoretic particle having specified chemical compositions. Finally, U.S. Patent Application Publication No. 2014/0104675 describes a particle dispersion including first and second colored particles that move in response to an electric field, and a dispersion medium, the second colored particles having a larger diameter than the first colored particles and the same charging characteristic as a charging characteristic of the first color particles, and in which the ratio (Cs/Cl) of the charge amount Cs of the first colored particles to the charge amount Cl of the second colored particles per unit area of the display is less than or equal to 5. Some of the aforementioned displays do provide full color but at the cost of requiring addressing methods that are long and cumbersome.

U.S. Patent Applications Publication Nos. 2012/0314273 and 2014/0002889 describe an electrophoresis device including a plurality of first and second electrophoretic particles included in an insulating liquid, the first and second particles having different charging characteristics that are different from each other; the device further comprising a porous layer included in the insulating liquid and formed of a fibrous structure. These patent applications are not full color displays in the sense in which that term is used below.

See also U.S. Patent Application Publication No. 2011/0134506 and the aforementioned application Ser. No. 14/277,107; the latter describes a full color display using three different types of particles in a colored fluid, but the presence of the colored fluid limits the quality of the white state which can be achieved by the display.

To obtain a high-resolution display, individual pixels of a display must be addressable without interference from adjacent pixels. One way to achieve this objective is to provide an array of non-linear elements, such as transistors or diodes, with at least one non-linear element associated with each pixel, to produce an "active matrix" display. An addressing or pixel electrode, which addresses one pixel, is connected to an appropriate voltage source through the associated non-linear element. Typically, when the non-linear element is a transistor, the pixel electrode is connected to the drain of the transistor, and this arrangement will be assumed in the following description, although it is essentially arbitrary and the pixel electrode could be connected to the source of the transistor. Conventionally, in high resolution arrays, the pixels are arranged in a two-dimensional array of rows and columns, such that any specific pixel is uniquely defined by the intersection of one specified row and one specified column. The sources of all the transistors in each column are connected to a single column electrode, while the gates of all the transistors in each row are connected to a single row electrode; again the assignment of sources to rows and gates to columns is conventional but essentially arbitrary, and could be reversed if desired. The row electrodes are connected to a row driver, which essentially ensures that at any given moment only one row is selected, i.e., that there is applied to the selected row electrode a select voltage such as to ensure that all the transistors in the selected row are conductive, while there is applied to all other rows a non-select voltage such as to ensure that all the transistors in these non-selected rows remain non-conductive. The column electrodes are connected to column drivers, which place upon the various column electrodes voltages selected to drive the pixels in the selected row to their desired optical states. (The aforementioned voltages are relative to a common front electrode which is conventionally provided on the opposed side of the electro-optic medium from the non-linear array and extends across the whole display.) After a pre-selected interval known as the "line address time" the selected row is deselected, the next row is selected, and the voltages on the column drivers are changed so that the next line of the display is written. This process is repeated so that the entire display is written in a row-by-row manner.

Conventionally, each pixel electrode has associated therewith a capacitor electrode such that the pixel electrode and the capacitor electrode form a capacitor; see, for example, International Patent Application WO 01/07961. In some embodiments, N-type semiconductor (e.g., amorphous silicon) may be used to from the transistors and the "select" and "non-select" voltages applied to the gate electrodes can be positive and negative, respectively.

FIG. 1 of the accompanying drawings depicts an exemplary equivalent circuit of a single pixel of an electrophoretic display. As illustrated, the circuit includes a capacitor 10 formed between a pixel electrode and a capacitor electrode. The electrophoretic medium 20 is represented as a capacitor and a resistor in parallel. In some instances, direct or indirect coupling capacitance 30 between the gate electrode of the transistor associated with the pixel and the pixel electrode (usually referred to a as a "parasitic capacitance") may create unwanted noise to the display. Usually, the parasitic capacitance 30 is much smaller than that of the storage capacitor 10, and when the pixel rows of a display is being selected or deselected, the parasitic capacitance 30 may result in a small negative offset voltage to the pixel electrode, also known as a "kickback voltage", which is usually less than 2 volts. In some embodiments, to compensate for the unwanted "kickback voltage", a common potential $V_{com}$, may be supplied to the top plane electrode and the capacitor electrode associated with each pixel, such that, when $V_{com}$ is set to a value equal to the kickback voltage ($V_{KB}$), every voltage supplied to the display may be offset by the same amount, and no net DC-imbalance experienced.

Problems may arise, however, when $V_{com}$ is set to a voltage that is not compensated for the kickback voltage. This may occur when it is desired to apply a higher voltage to the display than is available from the backplane alone. It is well-known in the art that, for example, the maximum voltage applied to the display may be doubled if the backplane is supplied with a choice of a nominal +V, 0, or −V, for example, while $V_{com}$ is supplied with −V. The maximum voltage experienced in this case is +2V (i.e., at the backplane relative to the top plane), while the minimum is zero. If negative voltages are needed, the $V_{com}$ potential must be raised at least to zero. Waveforms used to address a display with positive and negative voltages using top plane switching must therefore have particular frames allocated to each of more than one $V_{com}$ voltage setting.

A set of waveforms for driving a color electrophoretic display having four particles described in U.S. application Ser. No. 14/849,658, incorporated by reference herein. In U.S. application Ser. No. 14/849,658, seven different voltages are applied to the pixel electrodes: three positive, three negative, and zero. However, in some embodiments, the maximum voltages used in these waveforms are higher than that can be handled by amorphous silicon thin-film transistors. In such instances, suitable high voltages can be obtained by the use of top plane switching. When (as described above) $V_{com}$ is deliberately set to $V_{KB}$, a separate power supply may be used. It is costly and inconvenient, however, to use as many separate power supplies as there are $V_{com}$ settings when top plane switching is used. Furthermore, top plane switching is known to increase kickback, thereby degrading the stability of the color states. Therefore, there is a need for methods to compensate for the DC-offset caused by the kickback voltage using the same power supply for the back plane and $V_{com}$. Of course, complete DC-offset results in longer impulse sequences and therefore longer image refreshes.

SUMMARY OF INVENTION

The invention involves drivers configured to deliver two-part reset pulses to pixels in color electrophoretic displays. The two-part reset pulses are effective in removing last state information, but do not require more energy or time than needed. As a result, the described controllers allow a three (or more)-particle electrophoretic display to update faster while using less energy. Surprisingly, the controllers also provide a larger color gamut when the reset pulses are tuned for individual colors. The invention additionally provides a method of driving an electro-optic display which is DC balanced despite the existence of kickback voltages and changes in the voltages applied to the front electrode.

In an aspect the invention involves a method for driving an electrophoretic display having a front electrode, a backplane, and a display medium positioned between the front electrode and the backplane, the display medium comprising three sets of differently-colored particles. The method comprises applying a reset phase and a color transition phase to the display. The reset phase comprises applying a first signal having a first polarity, a first amplitude as a function of time, and a first duration on the front electrode, applying a second signal having a second polarity opposite the first polarity, a second amplitude as a function of time, during the first duration on the backplane, applying a third signal having the second polarity opposite the first polarity, a third amplitude as a function of time, during the second duration on the front electrode, applying a fourth signal equal to the sum of the first and second amplitudes, during the second duration on the backplane. The color transition phase comprises applying a fifth signal having the second polarity, a fourth amplitude as a function of time, and a third duration preceded by the first and second durations on the front electrode, applying a sixth signal having the first polarity, a fifth amplitude as a function of time, and a fourth duration preceded by the first and second durations on the backplane, wherein the sum of the first and second amplitudes as a function of time integrated over the first duration, and the sum of the first, second, and third amplitudes as a function of time integrated over the second duration, and the fourth amplitude as a function of time integrated over the third duration, and the fifth amplitude as a function of time integrated over the fourth duration produces an impulse offset designed to maintain a DC-balance on the display medium over the reset phase and the color transition phase. In some embodiments, the reset phase erases previous optical properties rendered on the display. In some embodiments, the color transition phase substantially changes the optical property displayed by the display. In some embodiments, the first polarity is a negative voltage. In some embodiments, the first polarity is a positive voltage. In some embodiments, the impulse offset is proportional to a kickback voltage experienced by the display medium. In some embodiments, the fourth duration occurs during the third duration. In some embodiments, the third duration and the fourth duration initiate at the same time.

In another aspect, the invention includes a method for driving an electrophoretic display having a front electrode, a backplane, and a display medium positioned between the front electrode and the backplane, the display medium comprising three sets of differently-colored particles, the method comprises applying a reset phase and a color transition phase to the display. The reset phase comprises applying a first signal having a first polarity, a first amplitude as a function of time, and a first duration on the front electrode, applying no signal during the first duration on the backplane, applying a second signal having a second polarity opposite the first polarity, a second amplitude as a function of time, during a second duration on the front electrode, applying a third signal having the first polarity, and a third amplitude as a function of time, during the second duration on the backplane. The color transition phase comprises applying a fourth signal having the first polarity, a fourth amplitude as a function of time, and a third duration preceded by the first and second durations on the front electrode, applying a fifth signal having the second polarity, a fifth amplitude as a function of time, and a fourth duration preceded by the first and second durations on the backplane, wherein the sum of the first amplitude as a function of time integrated over the first duration, and the sum of the second and third amplitudes as a function of time integrated over the second duration, and the fourth amplitude as a function of time integrated over the third duration, and the fifth amplitude as a function of time integrated over the fourth duration produces an impulse offset designed to maintain a DC-balance on the display medium over the reset phase and the color transition phase. In some embodiments, the reset phase erases previous optical properties rendered on the display. In some embodiments, the color transition phase substantially changes the optical property displayed by the display. In some embodiments, the first polarity is a negative voltage. In some embodiments, the first polarity is a positive voltage. In some embodiments, the impulse offset is proportional to a kickback voltage experienced by the display medium. In some embodiments, the fourth duration occurs during the third duration. In some embodiments, the third duration and the fourth duration initiate at the same time.

In another aspect, the invention includes a controller for an electrophoretic display comprising a front electrode, a backplane, and a display medium positioned between the front electrode and the backplane, the display medium comprising three sets of differently-colored particles, the controller being operatively coupled to the front electrode and the backplane, and configured to apply a reset phase and a color transition phase to the display. The reset phase comprises applying a first signal having a first polarity, a first amplitude as a function of time, and a first duration on the front electrode, applying a second signal having a second polarity opposite the first polarity, a second amplitude as a function of time, during the first duration on the backplane, applying a third signal having the second polarity opposite the first polarity, a third amplitude as a function of time, during the second duration on the front electrode, applying a fourth signal equal to the sum of the first and second amplitudes, during the second duration on the backplane. The color transition phase comprises applying a fifth signal having the second polarity, a fourth amplitude as a function of time, and a third duration preceded by the first and second durations on the front electrode, applying a sixth signal having the first polarity, a fifth amplitude as a function of time, and a fourth duration preceded by the first and second durations on the backplane, wherein the sum of the first and second amplitudes as a function of time integrated over the first duration, and the sum of the first, second, and third amplitudes as a function of time integrated over the second duration, and the fourth amplitude as a function of time integrated over the third duration, and the fifth amplitude as a function of time integrated over the fourth duration produces an impulse offset designed to maintain a DC-balance on the display medium over the reset phase and the color transition phase. In some embodiments, the controller applies a different reset phase depending upon the color to be displayed by the electrophoretic display. In some embodiments, the display medium comprises white, cyan, yellow, and magenta particles. In some embodiments, the display medium comprises white, red, blue, and green particles.

In another aspect, the invention includes a controller for an electrophoretic display comprising a front electrode, a backplane, and a display medium positioned between the front electrode and the backplane, the display medium comprising three sets of differently-colored particles, the controller being operatively coupled to the front electrode and the backplane, and configured to apply a reset phase and a color transition phase to the display. The reset phase comprises applying a first signal having a first polarity, a first amplitude as a function of time, and a first duration on the front electrode, applying no signal during the first duration on the backplane, applying a second signal having a second polarity opposite the first polarity, a second amplitude as a function of time, during a second duration on the front electrode, applying a third signal having the first polarity, and a third amplitude as a function of time, during the second duration on the backplane. The color transition phase comprises applying a fourth signal having the first polarity, a fourth amplitude as a function of time, and a third duration preceded by the first and second durations on the front electrode, applying a fifth signal having the second polarity, a fifth amplitude as a function of time, and a fourth duration preceded by the first and second durations on the backplane, wherein the sum of the first amplitude as a function of time integrated over the first duration, and the sum of the second and third amplitudes as a function of time integrated over the second duration, and the fourth amplitude as a function of time integrated over the third duration, and the fifth amplitude as a function of time integrated over the fourth duration produces an impulse offset designed to maintain a DC-balance on the display medium over the reset phase and the color transition phase. In some embodiments, the controller applies a different reset phase depending upon the color to be displayed by the electrophoretic display. In some embodiments, the display medium comprises white, cyan, yellow, and magenta particles. In some embodiments, the display medium comprises white, red, blue, and green particles.

The electrophoretic media used in the display of the present invention may be any of those described in the aforementioned application Ser. No. 14/849,658. Such media comprise a light-scattering particle, typically white, and three substantially non-light-scattering particles. The electrophoretic medium of the present invention may be in any of the forms discussed above. Thus, the electrophoretic medium may be unencapsulated, encapsulated in discrete capsules surrounded by capsule walls, or in the form of a polymer-dispersed or microcell medium.

BRIEF DESCRIPTION OF DRAWINGS

FIG. 2 is a schematic cross-section showing the positions of the various colored particles in an electrophoretic medium of the present invention when displaying black, white, the three subtractive primary and the three additive primary colors.

DETAILED DESCRIPTION

Figure 1:
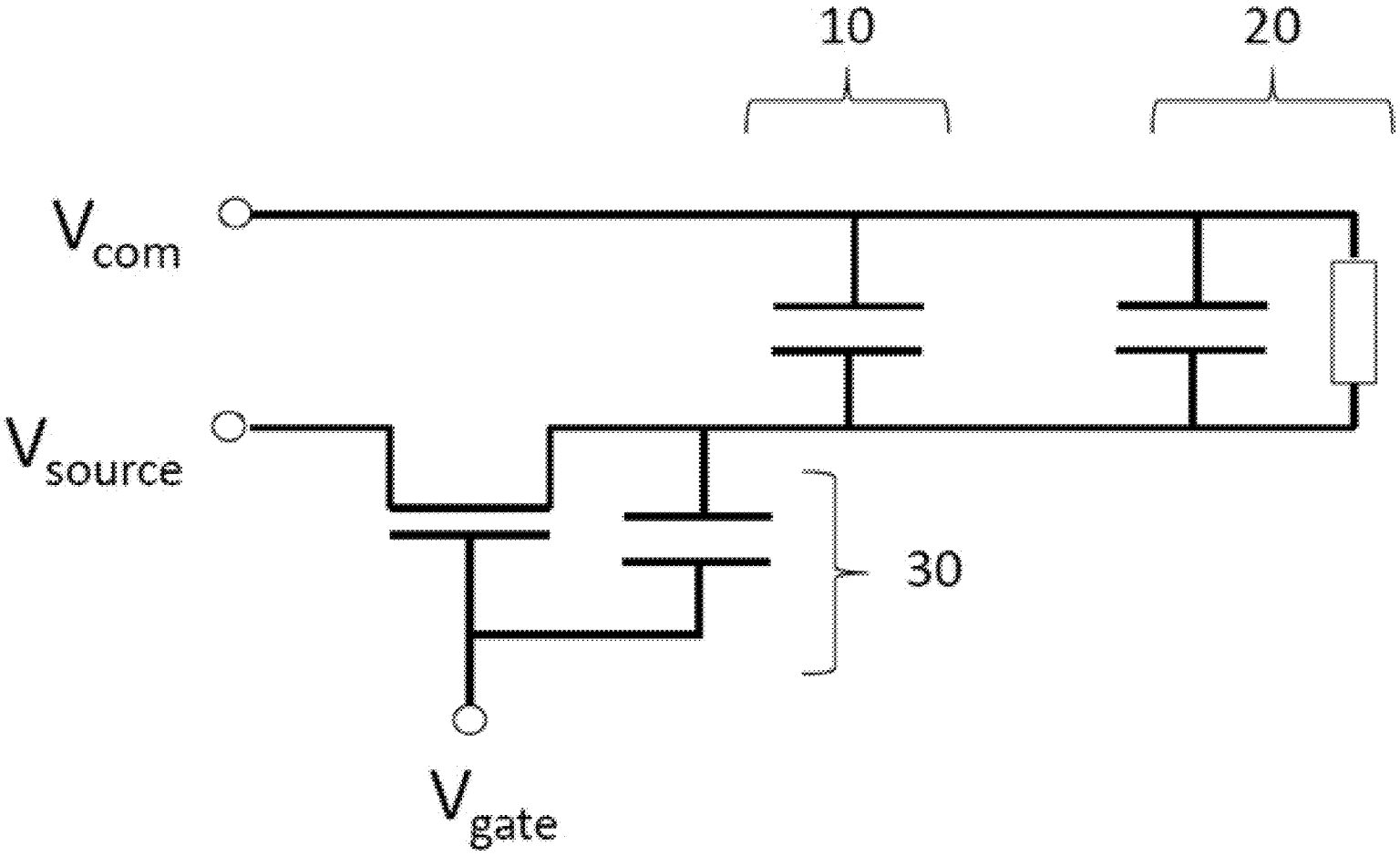
FIG. 1 illustrates an exemplary equivalent circuit of a single pixel of an electrophoretic display.

As indicated above, the present invention may be used with an electrophoretic medium which comprises one light-scattering particle (typically white) and three other particles providing the three subtractive primary colors. Such as system is shown schematically in FIG. 2, and it can provide white, yellow, red, magenta, blue, cyan, green, and black at every pixel.

The three particles providing the three subtractive primary colors may be substantially non-light-scattering ("SNLS"). The use of SNLS particles allows mixing of colors and provides for more color outcomes than can be achieved with the same number of scattering particles. The aforementioned U.S. Pat. No. 8,587,859 uses particles having subtractive primary colors, but requires two different voltage thresholds for independent addressing of the non-white particles (i.e., the display is addressed with three positive and three negative voltages). These thresholds must be sufficiently separated for avoidance of cross-talk, and this separation necessitates the use of high addressing voltages for some colors. In addition, addressing the colored particle with the highest threshold also moves all the other colored particles, and these other particles must subsequently be switched to their desired positions at lower voltages. Such a step-wise color-addressing scheme produces flashing of unwanted colors and a long transition time. The present invention does not require the use of a such a stepwise waveform and addressing to all colors can, as described below, be achieved with only two positive and two negative voltages (i.e., only five different voltages, two positive, two negative and zero are required in a display, although as described below in certain embodiments it may be preferred to use more different voltages to address the display).

Particles, and these other particles must subsequently be switched to their desired positions at lower voltages. Such a step-wise color-addressing scheme produces flashing of unwanted colors and a long transition time. The present invention does not require the use of a such a stepwise waveform and addressing to all colors can, as described below, be achieved with only two positive and two negative voltages (i.e., only five different voltages, two positive, two negative and zero are required in a display, although as described below in certain embodiments it may be preferred to use more different voltages to address the display).

As already mentioned, FIG. 2 of the accompanying drawings is a schematic cross-section showing the positions of the various particles in an electrophoretic medium of the present invention when displaying black, white, the three subtractive primary and the three additive primary colors. In FIG. 2, it is assumed that the viewing surface of the display is at the top (as illustrated), i.e., a user views the display from this direction, and light is incident from this direction. As already noted, in preferred embodiments only one of the four particles used in the electrophoretic medium of the present invention substantially scatters light, and in FIG. 2 this particle is assumed to be the white pigment. Basically, this light-scattering white particle forms a white reflector against which any particles above the white particles (as illustrated in FIG. 2) are viewed. Light entering the viewing surface of the display passes through these particles, is reflected from the white particles, passes back through these particles and emerges from the display. Thus, the particles above the white particles may absorb various colors and the color appearing to the user is that resulting from the combination of particles above the white particles. Any particles disposed below (behind from the user's point of view) the white particles are masked by the white particles and do not affect the color displayed. Because the second, third and fourth particles are substantially non-light-scattering, their order or arrangement relative to each other is unimportant, but for reasons already stated, their order or arrangement with respect to the white (light-scattering) particles is critical.

More specifically, when the cyan, magenta and yellow particles lie below the white particles (Situation [A] in FIG. 2), there are no particles above the white particles and the pixel simply displays a white color. When a single particle is above the white particles, the color of that single particle is displayed, yellow, magenta and cyan in Situations [B], [D] and [F] respectively in FIG. 2. When two particles lie above the white particles, the color displayed is a combination of those of these two particles; in FIG. 2, in Situation [C], magenta and yellow particles display a red color, in Situation [E], cyan and magenta particles display a blue color, and in Situation [G], yellow and cyan particles display a green color. Finally, when all three colored particles lie above the white particles (Situation [H] in FIG. 2), all the incoming light is absorbed by the three subtractive primary colored particles and the pixel displays a black color.

It is possible that one subtractive primary color could be rendered by a particle that scatters light, so that the display would comprise two types of light-scattering particle, one of which would be white and another colored. In this case, however, the position of the light-scattering colored particle with respect to the other colored particles overlying the white particle would be important. For example, in rendering the color black (when all three colored particles lie over the white particles) the scattering colored particle cannot lie over the non-scattering colored particles (otherwise they will be partially or completely hidden behind the scattering particle and the color rendered will be that of the scattering colored particle, not black).

It would not be easy to render the color black if more than one type of colored particle scattered light.

FIG. 2 shows an idealized situation in which the colors are uncontaminated (i.e., the light-scattering white particles completely mask any particles lying behind the white particles). In practice, the masking by the white particles may be imperfect so that there may be some small absorption of light by a particle that ideally would be completely masked.

Such contamination typically reduces both the lightness and the chroma of the color being rendered. In the electrophoretic medium of the present invention, such color contamination should be minimized to the point that the colors formed are commensurate with an industry standard for color rendition. A particularly favored standard is SNAP (the standard for newspaper advertising production), which specifies L*, a* and b* values for each of the eight primary colors referred to above. (Hereinafter, "primary colors" will be used to refer to the eight colors, black, white, the three subtractive primaries and the three additive primaries as shown in FIG. 2.)

Methods for electrophoretically arranging a plurality of different colored particles in "layers" as shown in FIG. 2 have been described in the prior art. The simplest of such methods involves "racing" pigments having different electrophoretic mobilities; see for example U.S. Pat. No. 8,040,594. Such a race is more complex than might at first be appreciated, since the motion of charged pigments itself changes the electric fields experienced locally within the electrophoretic fluid. For example, as positively-charged particles move towards the cathode and negatively-charged particles towards the anode, their charges screen the electric field experienced by charged particles midway between the two electrodes. It is thought that, while pigment racing is involved in the electrophoretic of the present invention, it is not the sole phenomenon responsible for the arrangements of particles illustrated in FIG. 2.

A second phenomenon that may be employed to control the motion of a plurality of particles is hetero-aggregation between different pigment types; see, for example, the aforementioned US 2014/0092465. Such aggregation may be charge-mediated (Coulombic) or may arise as a result of, for example, hydrogen bonding or Van der Waals interactions. The strength of the interaction may be influenced by choice of surface treatment of the pigment particles. For example, Coulombic interactions may be weakened when the closest distance of approach of oppositely-charged particles is maximized by a steric barrier (typically a polymer grafted or adsorbed to the surface of one or both particles). In the present invention, as mentioned above, such polymeric barriers are used on the first, and second types of particles and may or may not be used on the third and fourth types of particles.

A third phenomenon that may be exploited to control the motion of a plurality of particles is voltage- or current-dependent mobility, as described in detail in the aforementioned application Ser. No. 14/277,107.

Figure 3:
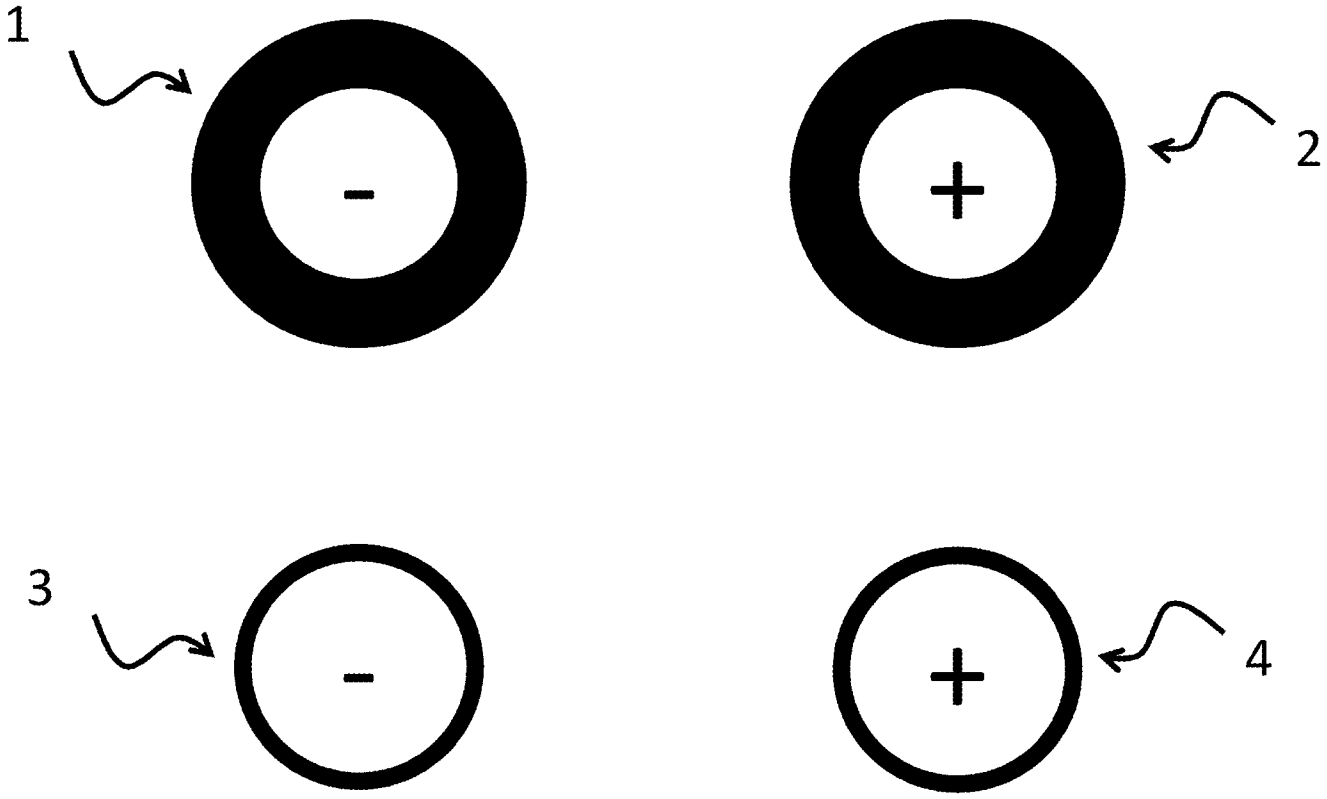
FIG. 3 shows in schematic form the four types of different pigment particles used in a multi-particle electrophoretic medium.

FIG. 3 shows schematic cross-sectional representations of the four pigment types (1-4) used in preferred embodiments of the invention. The polymer shell adsorbed to the core pigment is indicated by the dark shading, while the core pigment itself is shown as unshaded. A wide variety of forms may be used for the core pigment: spherical, acicular or otherwise anisometric, aggregates of smaller particles (i.e., "grape clusters"), composite particles comprising small pigment particles or dyes dispersed in a binder, and so on as is well known in the art. The polymer shell may be a covalently-bonded polymer made by grafting processes or chemisorption as is well known in the art, or may be physisorbed onto the particle surface. For example, the polymer may be a block copolymer comprising insoluble and soluble segments. Some methods for affixing the polymer shell to the core pigments are described in the Examples below.

First and second particle types in one embodiment of the invention preferably have a more substantial polymer shell than third and fourth particle types. The light-scattering white particle is of the first or second type (either negatively or positively charged). In the discussion that follows it is assumed that the white particle bears a negative charge (i.e., is of Type 1), but it will be clear to those skilled in the art that the general principles described will apply to a set of particles in which the white particles are positively charged.

In the present invention the electric field required to separate an aggregate formed from mixtures of particles of types 3 and 4 in the suspending solvent containing a charge control agent is greater than that required to separate aggregates formed from any other combination of two types of particle. The electric field required to separate aggregates formed between the first and second types of particle is, on the other hand, less than that required to separate aggregates formed between the first and fourth particles or the second and third particles (and of course less than that required to separate the third and fourth particles).

In FIG. 3 the core pigments comprising the particles are shown as having approximately the same size, and the zeta potential of each particle, although not shown, is assumed to be approximately the same. What varies is the thickness of the polymer shell surrounding each core pigment. As shown in FIG. 3, this polymer shell is thicker for particles of types 1 and 2 than for particles of types 3 and 4—and this is in fact a preferred situation for certain embodiments of the invention.

In order to understand how the thickness of the polymer shell affects the electric field required to separate aggregates of oppositely-charged particles, it may be helpful to consider the force balance between particle pairs. In practice, aggregates may be composed of a great number of particles and the situation will be far more complex than is the case for simple pairwise interactions. Nevertheless, the particle pair analysis does provide some guidance for understanding of the present invention.

The force acting on one of the particles of a pair in an electric field is given by:

$$\vec{F}_{Total}=\vec{F}_{App}+\vec{F}_{C}+\vec{F}_{VW}+\vec{F}_{D} \tag{1}$$

Where $F_{App}$ is the force exerted on the particle by the applied electric field, $F_C$ is the Coulombic force exerted on the particle by the second particle of opposite charge, $F_{VW}$ is the attractive Van der Waals force exerted on one particle by the second particle, and $F_D$ is the attractive force exerted by depletion flocculation on the particle pair as a result of (optional) inclusion of a stabilizing polymer into the suspending solvent.

The force $F_{App}$ exerted on a particle by the applied electric field is given by:

$$\vec{F}_{App}=q\vec{E}=4\pi\varepsilon_r\varepsilon_0(a+s)\zeta\vec{E} \tag{2}$$

where q is the charge of the particle, which is related to the zeta potential (ζ) as shown in equation (2) (approximately, in the Huckel limit), where a is the core pigment radius, s is the thickness of the solvent-swollen polymer shell, and the other symbols have their conventional meanings as known in the art.

The magnitude of the force exerted on one particle by another as a result of Coulombic interactions is given approximately by:

$$F_C=\frac{4\pi\varepsilon_r\varepsilon_0(a_1+s_1)(a_2+s_2)\zeta_1\zeta_2}{(a_1+s_1+a_2+s_2)^2} \tag{3}$$

for particles 1 and 2.

Note that the $F_{App}$ forces applied to each particle act to separate the particles, while the other three forces are attractive between the particles. If the $F_{App}$ force acting on one particle is higher than that acting on the other (because the charge on one particle is higher than that on the other) according to Newton's third law, the force acting to separate the pair is given by the weaker of the two $F_{App}$ forces.

It can be seen from (2) and (3) that the magnitude of the difference between the attracting and separating Coulombic terms is given by:

$$F_{App}-F_C=4\pi\varepsilon_r\varepsilon_0((a+s)\zeta|\vec{E}|-\zeta^2) \quad (4)$$

if the particles are of equal radius and zeta potential, so making (a+s) smaller or ζ larger will make the particles more difficult to separate. Thus, in one embodiment of the invention it is preferred that particles of types 1 and 2 be large, and have a relatively low zeta potential, while particles 3 and 4 be small, and have a relatively large zeta potential.

However, the Van der Waals forces between the particles may also change substantially if the thickness of the polymer shell increases. The polymer shell on the particles is swollen by the solvent and moves the surfaces of the core pigments that interact through Van der Waals forces further apart. For spherical core pigments with radii ($a_1$, $a_2$) much larger than the distance between them ($s_1+s_2$), $$F_{VW} = \frac{Aa_1a_2}{6(a_1+a_2)(s_1+s_2)^2} \quad (5)$$

where A is the Hamaker constant. As the distance between the core pigments increases the expression becomes more complex, but the effect remains the same: increasing $s_1$ or $s_2$ has a significant effect on reducing the attractive Van der Waals interaction between the particles.

With this background it becomes possible to understand the rationale behind the particle types illustrated in FIG. 3. Particles of types 1 and 2 have substantial polymeric shells that are swollen by the solvent, moving the core pigments further apart and reducing the Van der Waals interactions between them more than is possible for particles of types 3 and 4, which have smaller or no polymer shells. Even if the particles have approximately the same size and magnitude of zeta potential, according to the invention it will be possible to arrange the strengths of the interactions between pairwise aggregates to accord with the requirements set out above.

For fuller details of preferred particles for use in the display of FIG. 3, the reader is referred to the aforementioned application Ser. No. 14/849,658.

Figure 4:
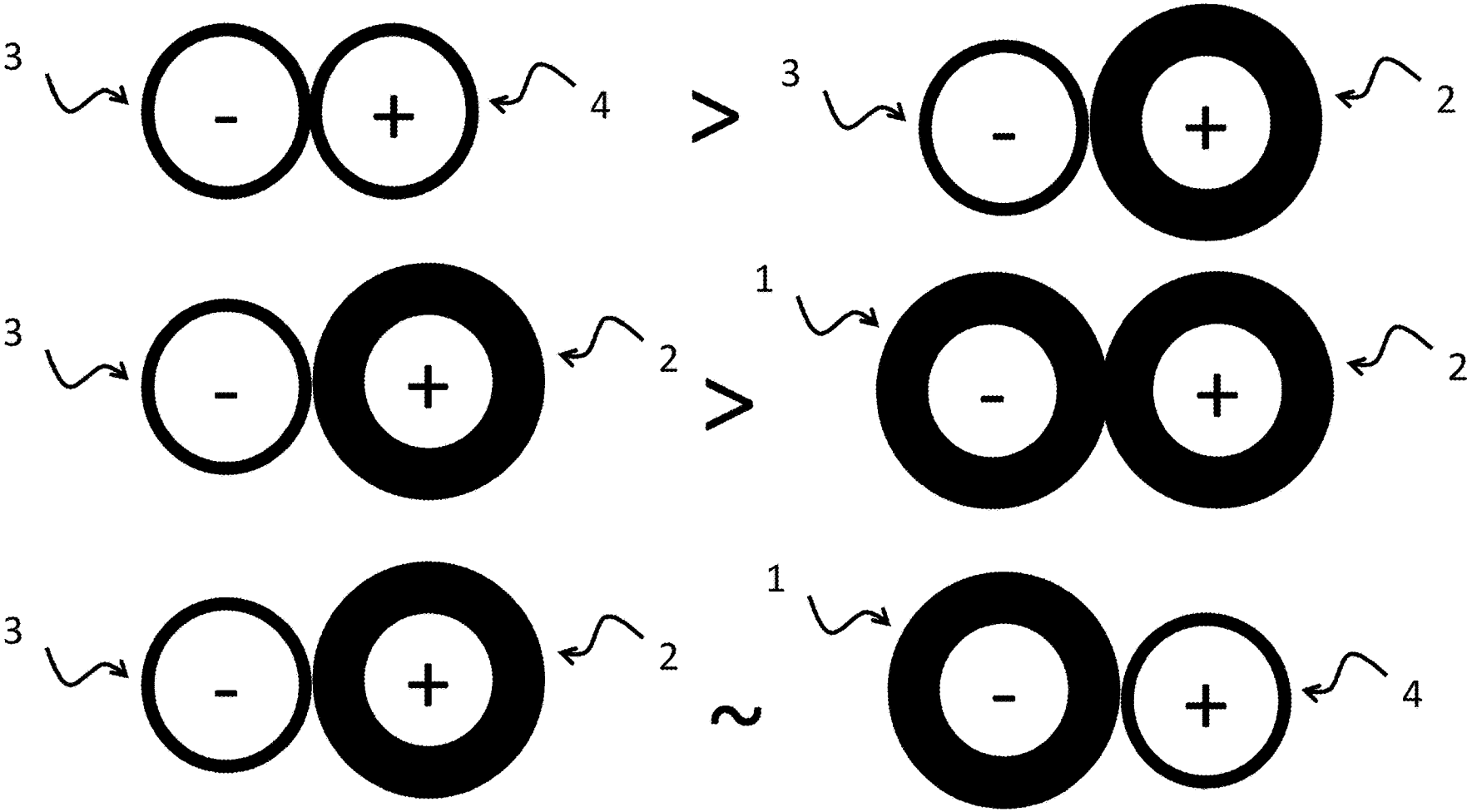
FIG. 4 shows in schematic form the relative strengths of interactions between pairs of particles in a multi-particle electrophoretic medium.

FIG. 4 shows in schematic form the strengths of the electric fields required to separate pairwise aggregates of the particle types of the invention. The interaction between particles of types 3 and 4 is stronger than that between particles of types 2 and 3. The interaction between particles of types 2 and 3 is about equal to that between particles of types 1 and 4 and stronger than that between particles of types 1 and 2. All interactions between pairs of particles of the same sign of charge as weak as or weaker than the interaction between particles of types 1 and 2.

Figure 5:
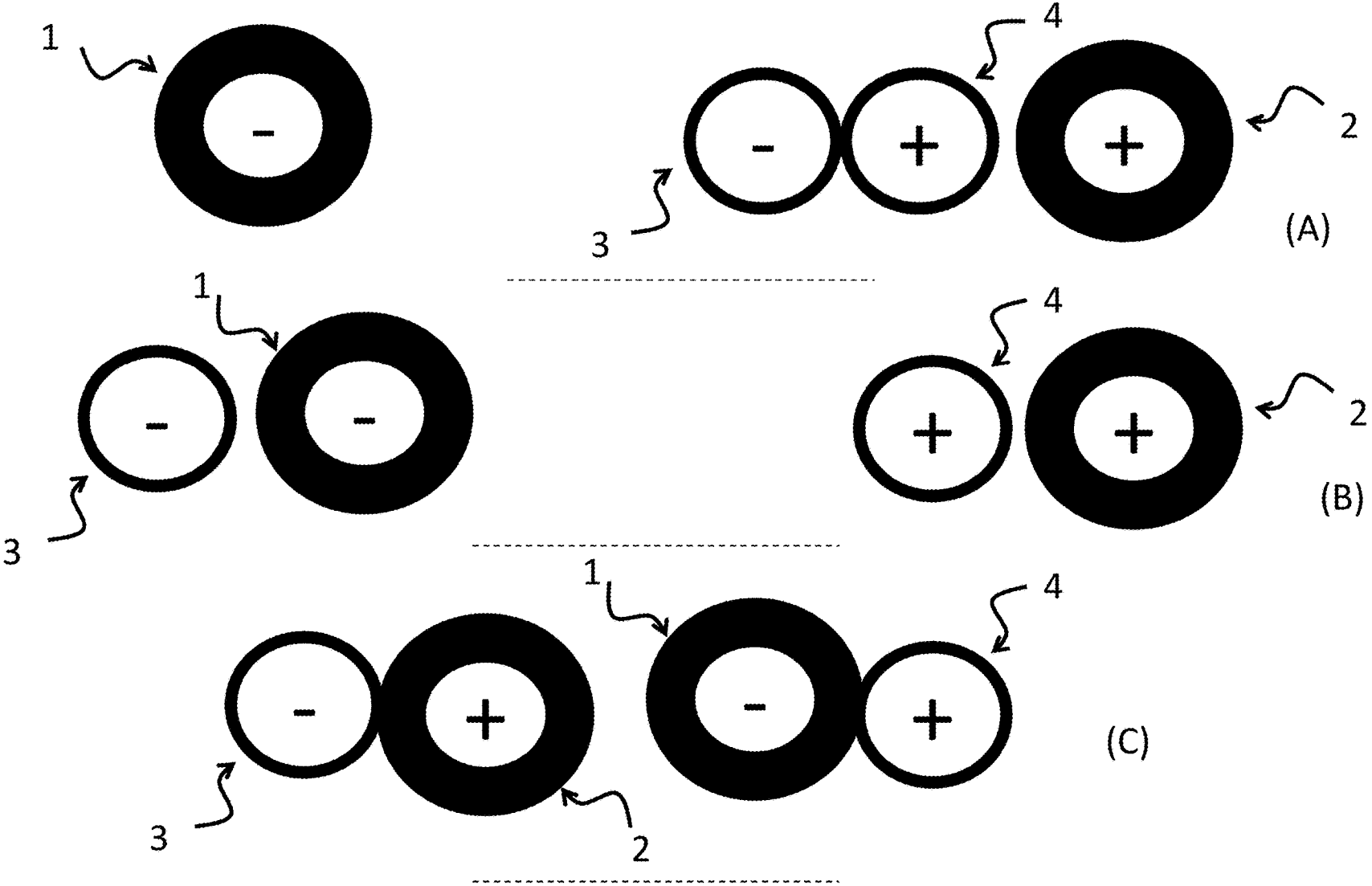
FIG. 5 shows behavior of multiple different particles in an electrophoretic medium when subjected to electric fields of varying strength and duration.

FIG. 5 shows how these interactions may be exploited to make all the primary colors (subtractive, additive, black and white), as was discussed generally with reference to FIG. 2.

When addressed with a low electric field (FIG. 5(A)), particles 3 and 4 are aggregated and not separated. Particles 1 and 2 are free to move in the field. If particle 1 is the white particle, the color seen viewing from the left is white, and from the right is black. Reversing the polarity of the field switches between black and white states. The transient colors between black and white states, however, are colored. The aggregate of particles 3 and 4 will move very slowly in the field relative to particles 1 and 2. Conditions may be found where particle 2 has moved past particle 1 (to the left) while the aggregate of particles 3 and 4 has not moved appreciably. In this case particle 2 will be seen viewing from the left while the aggregate of particles 3 and 4 will be seen viewing from the right. In certain embodiments of the invention the aggregate of particles 3 and 4 is weakly positively charged, and is therefore positioned in the vicinity of particle 2 at the beginning of such a transition.

When addressed with a high electric field (FIG. 5(B)), particles 3 and 4 are separated. Which of particles 1 and 3 (each of which has a negative charge) is visible when viewed from the left will depend upon the waveform (see below). As illustrated, particle 3 is visible from the left and the combination of particles 2 and 4 is visible from the right.

Starting from the state shown in FIG. 5(B), a low voltage of opposite polarity will move positively charged particles to the left and negatively charged particles to the right. However, the positively charged particle 4 will encounter the negatively charged particle 1, and the negatively charged particle 3 will encounter the positively charged particle 2. The result is that the combination of particles 2 and 3 will be seen viewing from the left and particle 4 viewing from the right.

As described above, preferably particle 1 is white, particle 2 is cyan, particle 3 is yellow and particle 4 is magenta.

The core pigment used in the white particle is typically a metal oxide of high refractive index as is well known in the art of electrophoretic displays. Examples of white pigments are described in the Examples below.

The core pigments used to make particles of types 2-4, as described above, provide the three subtractive primary colors: cyan, magenta and yellow.

A display device may be constructed using an electrophoretic fluid of the invention in several ways that are known in the prior art. The electrophoretic fluid may be encapsulated in microcapsules or incorporated into microcell structures that are thereafter sealed with a polymeric layer. The microcapsule or microcell layers may be coated or embossed onto a plastic substrate or film bearing a transparent coating of an electrically conductive material. This assembly may be laminated to a backplane bearing pixel electrodes using an electrically conductive adhesive.

A first embodiment of waveforms used to achieve each of the particle arrangements shown in FIG. 2 will now be described. In this discussion it is assumed that the first particles are white and negatively charged, the second particles cyan and positively charged, the third particles yellow and negatively charged, and the fourth particles magenta and positively charged. Those skilled in the art will understand how the color transitions will change if these assignments of particle colors are changed, as they can be provided that one of the first and second particles is white. Similarly, the polarities of the charges on all the particles can be inverted and the electrophoretic medium will still function in the same manner provided that the polarity of the waveforms (see next paragraph) used to drive the medium is similarly inverted.

In the discussion that follows, the waveform (voltage against time curve) applied to the pixel electrode of the backplane of a display of the invention is described and plotted, while the front electrode is assumed to be grounded (i.e., at zero potential). The electric field experienced by the electrophoretic medium is of course determined by the difference in potential between the backplane and the front electrode and the distance separating them. The display is typically viewed through its front electrode, so that it is the particles adjacent the front electrode which control the color displayed by the pixel, and if it is sometimes easier to understand the optical transitions involved if the potential of the front electrode relative to the backplane is considered; this can be done simply by inverting the waveforms discussed below.

These waveforms require that each pixel of the display can be driven at five different addressing voltages, designated $+V_{high}$, $+V_{low}$, 0, $-V_{low}$ and $-V_{high}$, illustrated as 30V, 15V, 0, −15V and −30V. In practice it may be preferred to use a larger number of addressing voltages. If only three voltages are available (i.e., $+V_{high}$, 0, and $-V_{high}$) it may be possible to achieve the same result as addressing at a lower voltage (say, $V_{high}/n$ where n is a positive integer >1) by addressing with pulses of voltage $V_{high}$ but with a duty cycle of 1/n.

Waveforms used in the present invention may comprise three phases: a DC-balancing phase, in which a DC imbalance due to previous waveforms applied to the pixel is corrected, or in which the DC imbalance to be incurred in the subsequent color rendering transition is corrected (as is known in the art), a "reset" phase, in which the pixel is returned to a starting configuration that is at least approximately the same regardless of the previous optical state of the pixel, and a "color rendering" phase as described below. The DC-balancing and reset phases are optional and may be omitted, depending upon the demands of the particular application. The "reset" phase, if employed, may be the same as the magenta color rendering waveform described below, or may involve driving the maximum possible positive and negative voltages in succession, or may be some other pulse pattern, provided that it returns the display to a state from which the subsequent colors may reproducibly be obtained.

The general principles used in production of the eight primary colors (white, black, cyan, magenta, yellow, red, green and blue) using this second drive scheme applied to a display of the present invention (such as that shown in FIG. 2) will now be described. It will be assumed that the first pigment is white, the second cyan, the third yellow and the fourth magenta. It will be clear to one of ordinary skill in the art that the colors exhibited by the display will change if the assignment of pigment colors is changed.

The greatest positive and negative voltages (designated±Vmax in FIG. 6) applied to the pixel electrodes produce respectively the color formed by a mixture of the second and fourth particles (cyan and magenta, to produce a blue color—cf. FIG. 2[E]), or the third particles alone (yellow—cf. FIG. 2[B]—the white pigment scatters light and lies in between the colored pigments). These blue and yellow colors are not necessarily the best blue and yellow attainable by the display. The mid-level positive and negative voltages (designated$\pm V_{mid}$ in FIG. 6) applied to the pixel electrodes produce colors that are black and white, respectively (although not necessarily the best black and white colors attainable by the display—cf. FIG. 5(A)).

Figure 6:
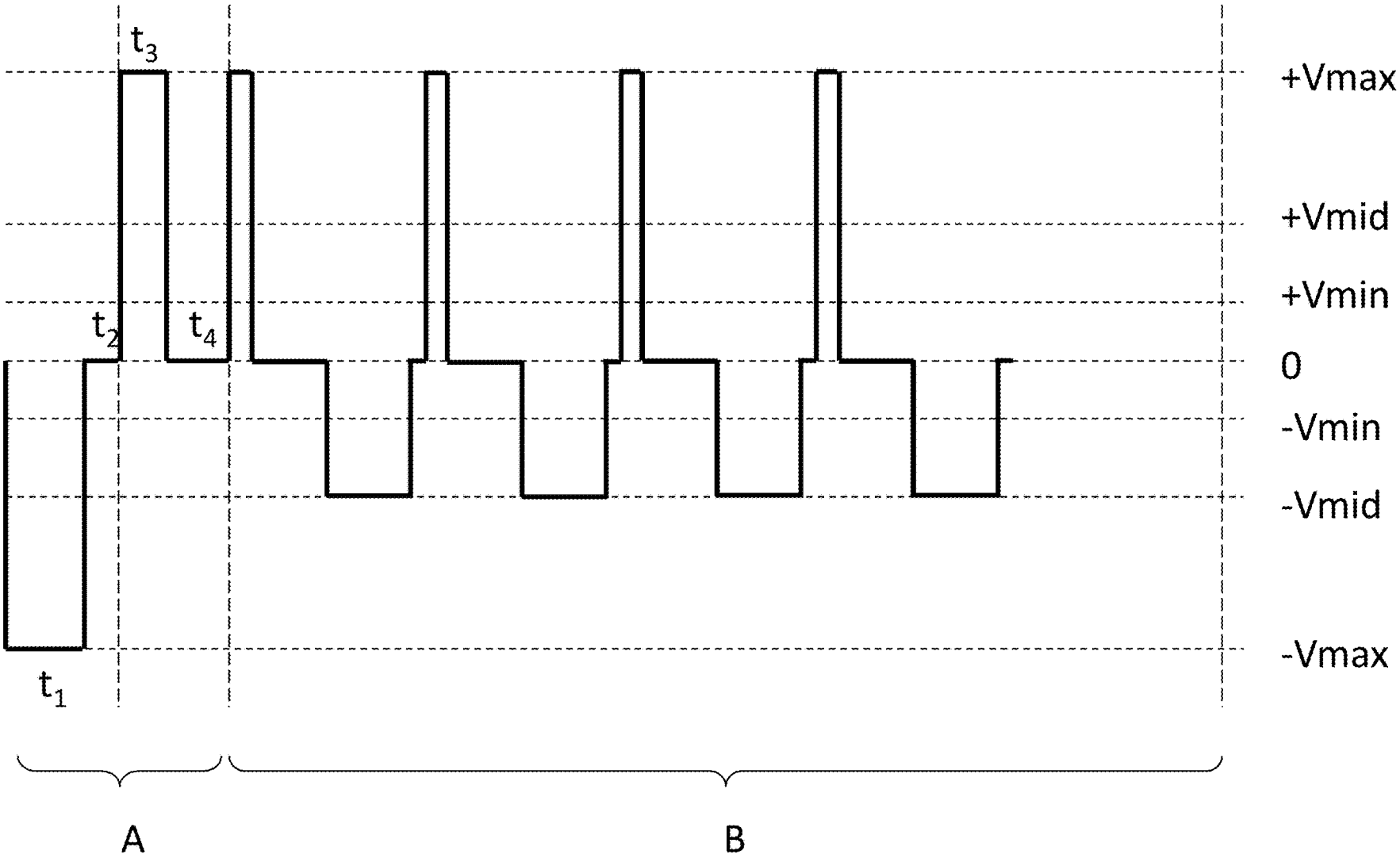
FIG. 6 is an exemplary waveform including a two-part reset phase (A) and a color transition phase (B)

From these blue, yellow, black or white optical states, the other four primary colors may be obtained by moving only the second particles (in this case the cyan particles) relative to the first particles (in this case the white particles), which is achieved using the lowest applied voltages (designated$\pm V_{min}$ in FIG. 6). Thus, moving cyan out of blue (by applying −Vmin to the pixel electrodes) produces magenta (cf. FIG. 2[E] and [D] for blue and magenta respectively); moving cyan into yellow (by applying +Vmin to the pixel electrodes) provides green (cf. FIG. 2[B] and [G] for yellow and green respectively); moving cyan out of black (by applying −Vmin to the pixel electrodes) provides red (cf. FIG. 2[H] and [C] for black and red respectively), and moving cyan into white (by applying +Vmin to the pixel electrodes) provides cyan (cf. FIG. 2[A] and [F] for white and cyan respectively).

While these general principles are useful in the construction of waveforms to produce particular colors in displays of the present invention, in practice the ideal behavior described above may not be observed, and modifications to the basic scheme are desirably employed.

A generic waveform for addressing a color electrophoretic display of the invention is illustrated in FIG. 6, in which the abscissa represents time (in arbitrary units) and the ordinate represents the voltage difference between a pixel electrode and the common front electrode. The magnitudes of the three positive voltages used in the drive scheme illustrated in FIG. 6 may lie between about +3V and +30V, and of the three negative voltages between about −3V and −30V. In one preferred embodiment, the highest positive voltage, $+V_{max}$, is +30V, the medium positive voltage, $+V_{mid}$, is 15V, and the lowest positive voltage, $+V_{min}$, is 9V. In a similar manner, negative voltages $-V_{max}$, $-V_{mid}$ and $-V_{min}$ are; in a preferred embodiment −30V, −15V and −9V. It is not necessary that the magnitudes of the voltages $|+V|=|-V|$ for any of the three voltage levels, although it may be preferable in some cases that this be so.

There are two distinct phases in the generic waveform illustrated in FIG. 6. In the first phase, there are supplied pulses (wherein "pulse" signifies a monopole square wave, i.e., the application of a constant voltage for a predetermined time) at $+V_{max}$ and $-V_{max}$ that serve to erase the previous image rendered on the display (i.e., to "reset" the display). The lengths of these pulses ($t_1$ and $t_3$) and of the rests (i.e., periods of zero voltage between them ($t_2$ and $t_4$) may be chosen so that the entire waveform (i.e., the integral of voltage with respect to time over the whole waveform as illustrated in FIG. 6) is DC balanced (i.e., the integral of voltage over time is substantially zero). DC balance can be achieved by adjusting the lengths of the pulses and rests in phase A so that the net impulse supplied in this phase is equal in magnitude and opposite in sign to the net impulse supplied in phase B, during which phase the display is switched to a particular desired color.

Herein the term "frame" refers to a single update of all the rows in the display. It will be clear to one of ordinary skill in the art that in a display of the invention driven using a thin-film transistor (TFT) array the available time increments on the abscissa of FIG. 6 will typically be quantized by the frame rate of the display. Likewise, it will be clear that the display is addressed by changing the potential of the pixel electrodes relative to the front electrode and that this may be accomplished by changing the potential of either the pixel electrodes or the front electrode, or both. In the present state of the art, typically a matrix of pixel electrodes is present on the backplane, whereas the front electrode is common to all pixels. Therefore, when the potential of the front electrode is changed, the addressing of all pixels is affected. The basic structure of the waveform described above with reference to FIG. 6 is the same whether or not varying voltages are applied to the front electrode.

The generic waveform illustrated in FIG. 6 requires that the driving electronics provide as many as seven different voltages to the data lines during the update of a selected row of the display. While multi-level source drivers capable of delivering seven different voltages are available, many commercially-available source drivers for electrophoretic displays permit only three different voltages to be delivered during a single frame (typically a positive voltage, zero, and a negative voltage). It is possible to modify the generic waveform of FIG. 6 to accommodate a three level source driver architecture provided that the three voltages supplied to the panel (typically +V, 0 and −V) can be changed from one frame to the next. (i.e., such that, for example, in frame n voltages ($+V_{max}$, 0, $-V_{min}$) could be supplied while in frame n+1 voltages ($+V_{mid}$, 0, $-V_{max}$) could be supplied).

Sometimes it may be desirable to use a so-called "top plane switching" driving scheme to control an electrophoretic display. In a top plane switching driving scheme, the top plane common electrode can be switched between −V, 0 and +V, while the voltages applied to the pixel electrodes can also vary from −V, 0 to +V with pixel transitions in one direction being handled when the common electrode is at 0 and transitions in the other direction being handled when the common electrode is at +V.

When top plane switching is used in combination with a three-level source driver, the same general principles apply as described above with reference to FIG. 6. Top plane switching may be preferred when the source drivers cannot supply a voltage as high as the preferred $V_{max}$. Methods for driving electrophoretic displays using top plane switching are well known in the art.

A typical waveform of the (E Ink) prior art is shown below in Table 1, where the numbers in parentheses correspond to the number of frames driven with the indicated backplane voltage (relative to a top plane assumed to be at zero potential).

TABLE 1

| | Reset Phase | | High/Mid V Phase (N repetitions of frame sequence below) | | | Low/Mid V phase | |
|---|---|---|---|---|---|---|---|
| K | $-Vmax(60 + \Delta_K)$ | $Vmax(60 - \Delta_K)$ | Vmid(5) | Zero(9) | | Zero(50) | |
| B | $-Vmax(60 + \Delta_B)$ | $Vmax(60 - \Delta_B)$ | Vmax(2) | Zero(5) | −Vmid(7) | Vmid(40) | Zero(10) |
| R | $-Vmax(60 + \Delta_R)$ | $Vmax(60 - \Delta_R)$ | Vmax(7) | Zero(3) | −Vmax(4) | Zero(50) | |
| M | $-Vmax(60 + \Delta_M)$ | $Vmax(60 - \Delta_M)$ | Vmax(4) | Zero(3) | −Vmid(7) | Zero(50) | |
| G | $-Vmax(60 + \Delta_G)$ | $Vmax(60 - \Delta_G)$ | Vmid(7) | Zero(3) | −Vmax(4) | Vmin(40) | Zero(10) |
| C | $-Vmax(60 + \Delta_C)$ | $Vmax(60 - \Delta_C)$ | Vmax(2) | Zero(5) | −Vmid(7) | Vmin(40) | Zero(10) |
| Y | $-Vmax(60 + \Delta_Y)$ | $Vmax(60 - \Delta_Y)$ | Vmid(7) | Zero(3) | −Vmax(4) | Zero(50) | |
| W | $-Vmax(60 + \Delta_W)$ | $Vmax(60 - \Delta_W)$ | Vmax(2) | Zero(5) | −Vmid(7) | Zero(50) | |

In the reset phase of this waveform, pulses of the maximum negative and positive voltages are provided to erase the previous state of the display. The number of frames at each voltage are offset by an amount (shows as Δx for color x) that compensates for the net impulse in the High/Mid voltage and Low/Mid voltage phases, where the color is rendered. To achieve DC balance, Δx is chosen to be half that net impulse. It is not necessary that the reset phase be implemented in precisely the manner illustrated in the Table; for example, when top plane switching is used it is necessary to allocate a particular number of frames to the negative and positive drives. In such a case, it is preferred to provide the maximum number of high voltage pulses consistent with achieving DC balance (i.e., to subtract 2Δx from the negative or positive frames as appropriate).

In the High/Mid voltage phase, as described above, a sequence of N repetitions of a pulse sequence appropriate to each color is provided, where N can be 1-20. As shown, this sequence comprises 14 frames that are allocated positive or negative voltages of magnitude Vmax or Vmid, or zero. The pulse sequences shown are in accord with the discussion given above. It can be seen that in this phase of the waveform the pulse sequences to render the colors white, blue and cyan are the same. Likewise, in this phase the pulse sequences to render yellow and green are the same (since green is achieved starting from a yellow state).

In the Low/Mid voltage phase the colors blue and cyan are obtained from white, and the color green from yellow.

The foregoing discussion of the waveforms, and specifically the discussion of DC balance, ignores the question of kickback voltage. In practice, as previously, every backplane voltage is offset from the voltage supplied by the power supply by an amounts equal to the kickback voltage $V_{KB}$. Thus, if the power supply used provides the three voltages +V, 0, and −V, the backplane would actually receive voltages $V+V_{KB}$, $V_{KB}$, and $-V+V_{KB}$ (note that $V_{KB}$, in the case of amorphous silicon TFTs, is usually a negative number). The same power supply would, however, supply +V, 0, and −V to the front electrode without any kickback voltage offset. Therefore, for example, when the front electrode is supplied with −V the display would experience a maximum voltage of $2V+V_{KB}$ and a minimum of $V_{KB}$. Instead of using a separate power supply to supply $V_{KB}$ to the front electrode, which can be costly and inconvenient, a waveform may be divided into sections where the front electrode is supplied with a positive voltage, a negative voltage, and $V_{KB}$.

Figure 7:
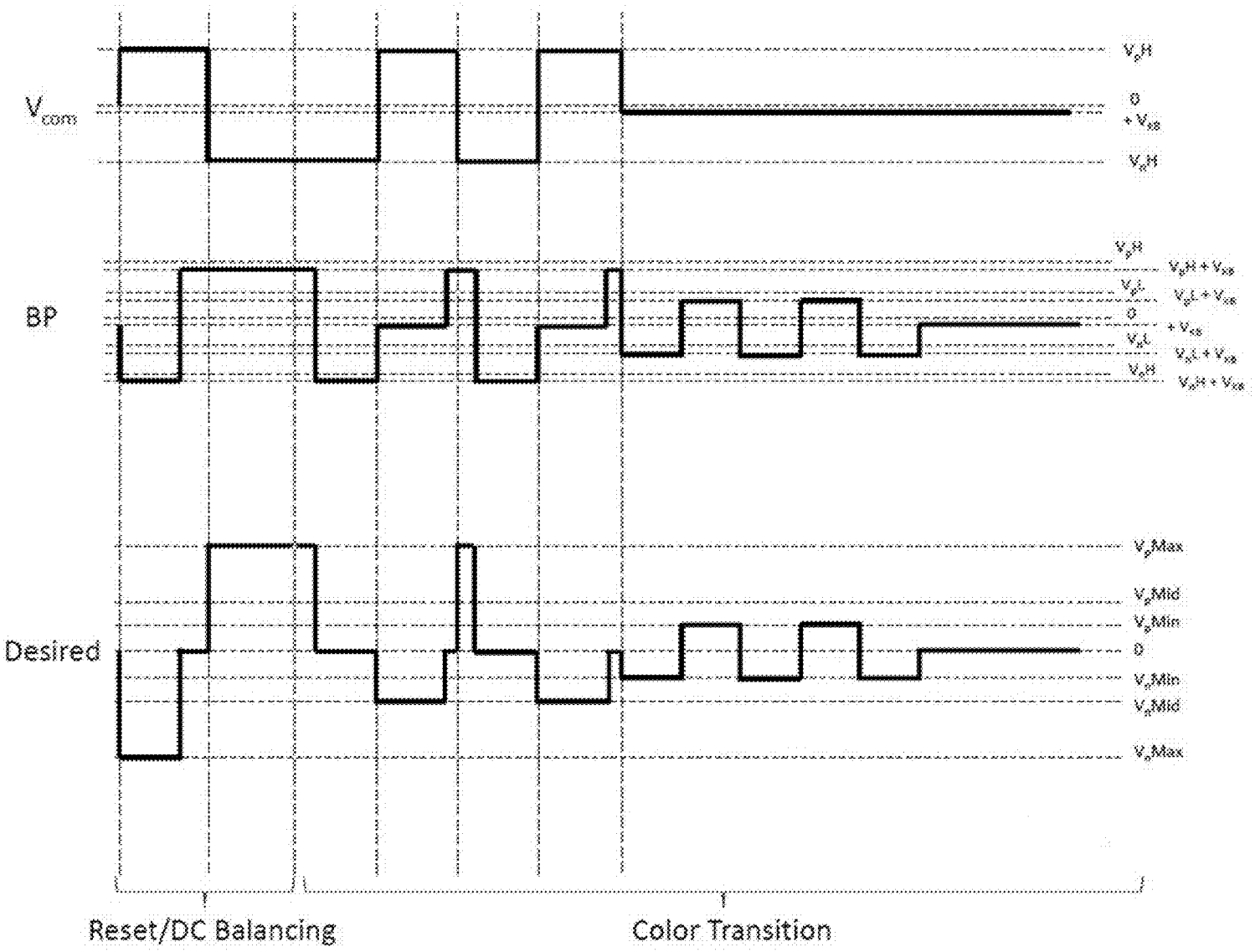
FIG. 7 is a schematic voltage against time diagram showing the variation with time of the front and pixel electrodes, and the resultant voltage across the electrophoretic medium, of a waveform used to generate one color in a drive scheme of the present invention.

As discussed above, in some of the waveforms described in the aforementioned application Ser. No. 14/849,658, seven different voltages can be applied to the pixel electrodes: three positive, three negative, and zero. Preferably, the maximum voltages used in these waveforms are higher than that can be handled by amorphous silicon thin-film transistors in the current state of the art. In such cases, high voltages can be obtained by the use of top plane switching, and the driving waveforms can be configured to compensate for the kickback voltage and can be intrinsically DC-balanced by the methods of the present invention. FIG. 7 depicts schematically one such waveform used to display a single color. As shown in FIG. 7, the waveforms for every color have the same basic form: i.e., the waveform is intrinsically DC-balanced and can comprise two sections or phases: (1) a preliminary series of frames that is used to provide a "reset" of the display to a state from which any color may reproducibly be obtained and during which a DC imbalance equal and opposite to the DC imbalance of the remainder of the waveform is provided, and (2) a series of frames that is particular to the color that is to be rendered; cf. Sections A and B of the waveform shown in FIG. 6.

During the first "reset" phase, the reset of the display ideally erases any memory of a previous state, including remnant voltages and pigment configurations specific to previously-displayed colors. Such an erasure is most effective when the display is addressed at the maximum possible voltage in the "reset/DC balancing" phase. In addition, sufficient frames may be allocated in this phase to allow for balancing of the most imbalanced color transitions. Since some colors require a positive DC-balance in the second section of the waveform and others a negative balance, in approximately half of the frames of the "reset/DC balancing" phase, the front electrode voltage $V_{com}$ is set to $V_{pH}$ (allowing for the maximum possible negative voltage between the backplane and the front electrode), and in the remainder, $V_{com}$ is set to $V_{nH}$ (allowing for the maximum possible positive voltage between the backplane and the front electrode). Empirically it has been found preferable to precede the $V_{com}=V_{nH}$ frames by the $V_{com}=V_{pH}$ frames.

The "desired" waveform (i.e., the actual voltage against time curve which is desired to apply across the electrophoretic medium) is illustrated at the bottom of FIG. 7, and its implementation with top plane switching is shown above, where the potentials applied to the front electrode ($V_{com}$) and to the backplane (BP) are illustrated. It is assumed that the column driver is used connected to a power supply capable of supplying the following voltages: $V_{pH}$, $V_{nH}$ (the highest positive and negative voltages, typically in the range of±10-15 V), $V_{pL}$, $V_{nL}$ (lower positive and negative voltages, typically in the range of±1-10 V), and zero. In addition to these voltages, a kickback voltage $V_{KB}$ (a small value that is specific to the particular backplane used, measured as described, for example, in U.S. Pat. No. 7,034,783) can be supplied to the front electrode by an additional power supply.

As shown in FIG. 7, every backplane voltage is offset by $V_{KB}$ (shown as a negative number) from the voltage supplied by the power supply while the front electrode voltages are not so offset, except when the front electrode is explicitly set to $V_{KB}$, as described above.

Although the display of the invention has been described as producing the eight primary colors, in practice, it is preferred that as many colors as possible be produced at the pixel level. A full color gray scale image may then be rendered by dithering between these colors, using techniques well known to those skilled in imaging technology. For example, in addition to the eight primary colors produced as described above, the display may be configured to render an additional eight colors. In one embodiment, these additional colors are: light red, light green, light blue, dark cyan, dark magenta, dark yellow, and two levels of gray between black and white. The terms "light" and "dark" as used in this context refer to colors having substantially the same hue angle in a color space such as CIE L*a*b* as the reference color but a higher or lower L*, respectively.

In general, light colors are obtained in the same manner as dark colors, but using waveforms having slightly different net impulse in phases B and C. Thus, for example, light red, light green and light blue waveforms have a more negative net impulse in phases B and C than the corresponding red, green and blue waveforms, whereas dark cyan, dark magenta, and dark yellow have a more positive net impulse in phases B and C than the corresponding cyan, magenta and yellow waveforms. The change in net impulse may be achieved by altering the lengths of pulses, the number of pulses, or the magnitudes of pulses in phases B and C.

Gray colors are typically achieved by a sequence of pulses oscillating between low or mid voltages.

It will be clear to one of ordinary skill in the art that in a display of the invention driven using a thin-film transistor (TFT) array the available time increments on the abscissa of FIG. 7 will typically be quantized by the frame rate of the display. Likewise, it will be clear that the display is addressed by changing the potential of the pixel electrodes relative to the front electrode and that this may be accomplished by changing the potential of either the pixel electrodes or the front electrode, or both. In the present state of the art, typically a matrix of pixel electrodes is present on the backplane, whereas the front electrode is common to all pixels. Therefore, when the potential of the front electrode is changed, the addressing of all pixels is affected. The basic structure of the waveform described above with reference to FIG. 7 is the same whether or not varying voltages are applied to the front electrode.

The generic waveform illustrated in FIG. 7 requires that the driving electronics provide as many as seven different voltages to the data lines during the update of a selected row of the display. While multi-level source drivers capable of delivering seven different voltages are available, many commercially-available source drivers for electrophoretic displays permit only three different voltages to be delivered during a single frame (typically a positive voltage, zero, and a negative voltage). Herein the term "frame" refers to a single update of all the rows in the display. It is possible to modify the generic waveform of FIG. 7 to accommodate a three level source driver architecture provided that the three voltages supplied to the panel (typically +V, 0 and −V) can be changed from one frame to the next. (i.e., such that, for example, in frame n voltages ($+V_{max}$, 0, $-V_{min}$) could be supplied while in frame n+1 voltages ($+V_{mid}$, 0, $-V_{max}$) could be supplied).

Referring now to FIG. 6, phase A (the reset phase) it is seen that this phase is divided into two sections of equal duration (illustrated by the dotted lines). When top plane switching is used, the top plane will be held at one potential in the first of these sections, and at a potential of the opposite polarity in the second section. In the particular case of FIG. 6, during the first such section the top plane would have been held at $V_pH$, and the backplane at $V_nH$, to achieve a potential drop across the electrophoretic fluid of $V_nH-V_pH$ (where the convention is used of referencing the backplane potential relative to that of the top plane). During the second section, the top plane would have been held at $V_nH$, and the backplane at $V_pH$. As shown, during the second section the electrophoretic fluid would have been subjected to a potential of $V_pH-V_nH$, the highest potential available. For rendition of certain colors, however, exposure to this high voltage might result in an initial pigment arrangement from which an ideal final configuration would be difficult to achieve. For example, as noted in the prior art, in order to render the color cyan, it is necessary for the magenta pigment (which has the same charge polarity as the cyan pigment) to be tied up in an aggregate with the yellow pigment. Such an aggregate would be split by a high applied potential, and thus the magenta would not be controlled and would contaminate the cyan.

It is not necessary, however, to use the maximum possible voltages in both sections of Phase A of the waveform. All that is required in Phase A is that the prior color state be erased such that the newly rendered color is the same no matter which color preceded it, and that the net impulse provided in Phase A balance the net impulse in Phase B.

Therefore, an experiment was conducted in which Phase B of a waveform of the type illustrated in Table 1 was held constant, while the voltages applied in each of two sections of phase A was varied (although the same number of frames was allocated to Phase A in each case: 120 frames in total, 60 frames for the first and 60 frames for the second sections). After addressing the display, the CIELab L*, a* and b* values of each primary color were measured.

Table 2 shows the default case in which the maximum possible negative and positive voltages are applied in the first and second sections of Phase A. This is done using top plane switching, in which the first listed voltage is applied to the backplane while the second listed voltage is applied to the top plane. The color gamut, measured as the volume of the convex hull containing the eight points listed in Table 2, is 21,336 $\Delta E^3$.

Table 3 shows the case where the backplane is held at zero during the first section of Phase A. The voltage applied is in this case less than in the case of Table 2. The voltage applied in the second section of Phase A is the same as the case for Table 2. In order to maintain DC balance, the time of application of the lower voltage must of course be correspondingly longer. The color gamut, measured as the volume of the convex hull containing the eight points listed in Table 2, is 20,987 $\Delta E^3$.

Table 4 shows the case where the backplane is held at zero during the second section of Phase A. The voltage applied in the first section of Phase A is the same as the case for Table 2. The color gamut, measured as the volume of the convex hull containing the eight points listed in Table 2, is 20,339 $\Delta E^3$.

TABLE 2

| First reset V | Second reset V | Color | L* | a* | b* |
|---|---|---|---|---|---|
| $V_nH$-$V_pH$ | $V_pH$-$V_nH$ | K | 24.67 | 2.68 | −12.53 |
| $V_nH$-$V_pH$ | $V_pH$-$V_nH$ | B | 37.26 | 0.97 | −14.51 |
| $V_nH$-$V_pH$ | $V_pH$-$V_nH$ | R | 43.2 | 16.16 | 11.34 |
| $V_nH$-$V_pH$ | $V_pH$-$V_nH$ | M | 43.56 | 21.93 | 40.65 |
| $V_nH$-$V_pH$ | $V_pH$-$V_nH$ | G | 36.29 | −19.89 | 13.13 |
| $V_nH$-$V_pH$ | $V_pH$-$V_nH$ | C | 48.34 | −9.82 | −6.73 |
| $V_nH$-$V_pH$ | $V_pH$-$V_nH$ | Y | 67.99 | −10.29 | 56.06 |
| $V_nH$-$V_pH$ | $V_pH$-$V_nH$ | W | 70.29 | 4.24 | 7.83 |

TABLE 3

| First reset V | Second reset V | Color | L* | a* | b* |
|---|---|---|---|---|---|
| 0-$V_pH$ | $V_pH$-$V_nH$ | K | 27.82 | 2.2 | −15.78 |
| 0-$V_pH$ | $V_pH$-$V_nH$ | B | 37.99 | 0.41 | 44.78 |
| 0-$V_pH$ | $V_pH$-$V_nH$ | R | 43.7 | 17 | 11.4 |
| 0-$V_pH$ | $V_pH$-$V_nH$ | M | 44.02 | 22.03 | −10.39 |
| 0-$V_pH$ | $V_pH$-$V_nH$ | G | 37.37 | −21.57 | 13.38 |
| 0-$V_pH$ | $V_pH$-$V_nH$ | C | 49.06 | −9.96 | −7.78 |
| 0-$V_pH$ | $V_pH$-$V_nH$ | Y | 67.73 | −10.25 | 53.71 |
| 0-$V_pH$ | $V_pH$-$V_nH$ | W | 70.02 | −0.99 | 6.7 |

TABLE 4

| First reset V | Second reset V | Color | L* | a* | b* |
|---|---|---|---|---|---|
| $V_nH$-$V_pH$ | 0-$V_nH$ | K | 27.42 | −4.03 | 40.77 |
| $V_nH$-$V_pH$ | 0-$V_nH$ | B | 31.99 | −7.38 | −11.16 |
| $V_nH$-$V_pH$ | 0-$V_nH$ | R | 46.19 | 8.49 | 21.11 |
| $V_nH$-$V_pH$ | 0-$V_nH$ | M | 47.46 | 12.8 | −3.05 |
| $V_nH$-$V_pH$ | 0-$V_nH$ | G | 33.33 | −24.63 | 11.2 |
| $V_nH$-$V_pH$ | 0-$V_nH$ | C | 43.03 | −19.38 | −9.32 |
| $V_nH$-$V_pH$ | 0-$V_nH$ | Y | 67.21 | −9.44 | 59.36 |
| $V_nH$-$V_pH$ | 0-$V_nH$ | W | 70.12 | −3.49 | 14.26 |

Figure 8B:
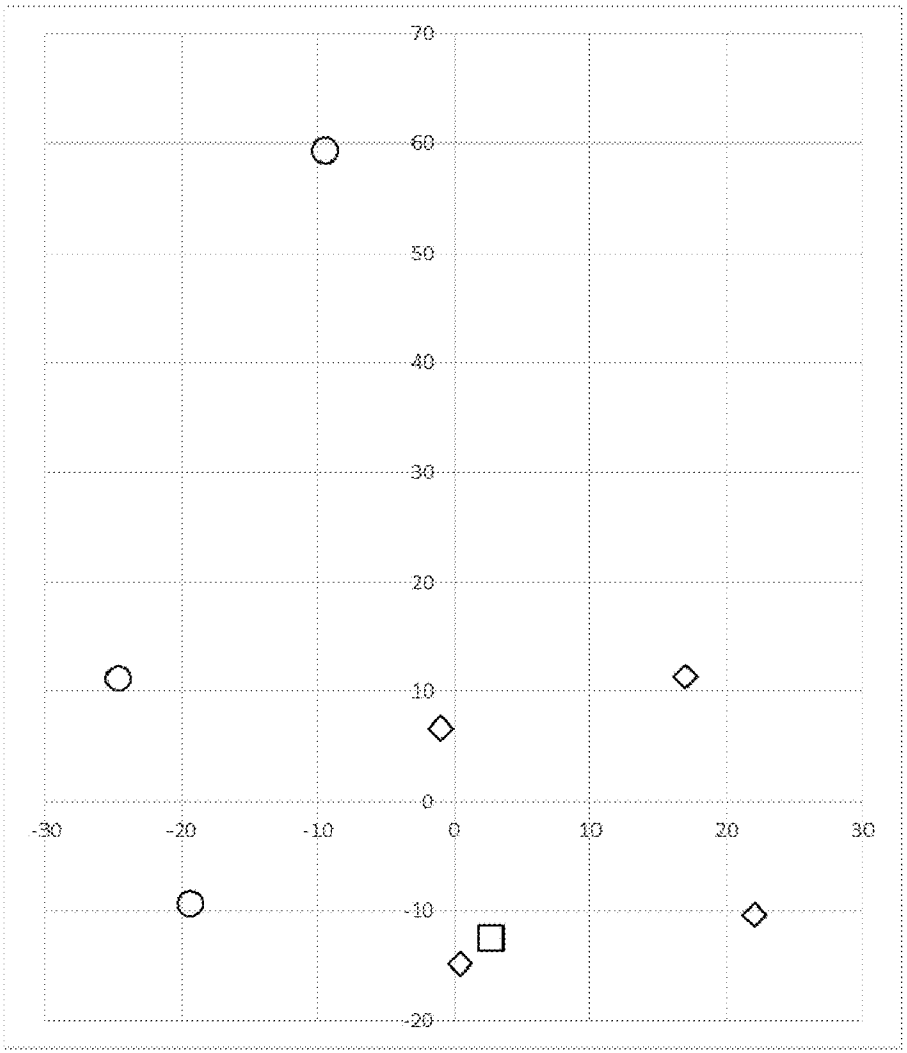
FIG. 8B shows the total experimental color gamut available by implementing a controller that changes the two-part reset phase depending upon the desired color.
Figure 8A:
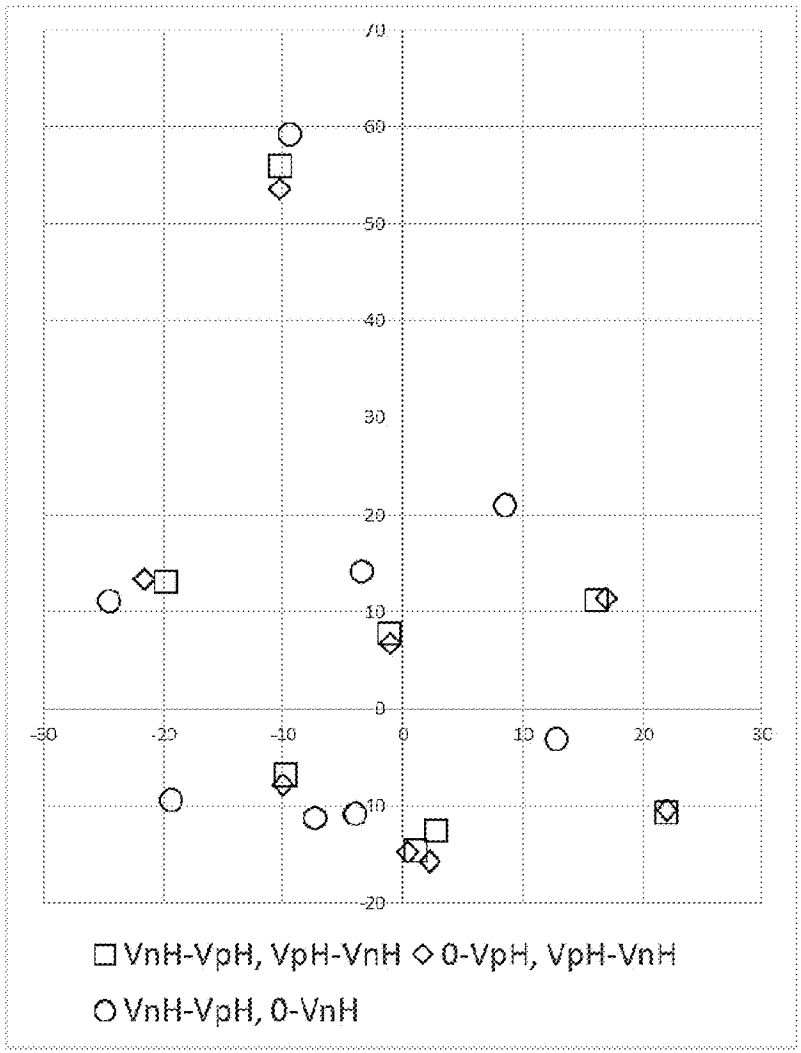
FIG. 8A shows experimental data of color gamuts produced with various voltage combinations of two-part reset phases.

FIG. 8A shows the results of these experiments as a projection onto the a*/b* plane: the abscissa represents a* and the ordinate b*. It can be seen that certain colors (for example, red, magenta, and blue) are rendered better by the Phase A settings corresponding to Tables 2 or 3, while other colors cyan, green and yellow) are rendered better by Phase A settings corresponding to Table 4.

Interestingly, the alternative experiment in which the order of the first and second sections of Phase A was reversed gave very poor results, with all colors being contaminated with yellow.

Table 5 shows the combination of best colors from this experiment. The color gamut, measured as the volume of the convex hull containing the eight points listed in Table 2, is 28,092 $\Delta E^3$. Thus, by appropriate choice of the voltages applied in the reset phase (Phase A) of the waveform, the color gamut was increased by a factor of about 50%. The results of Table 5 are depicted in FIG. 8B.

The method of this invention is particularly important when it is desired to make the waveform as short as possible. With fixed voltages in Phase A, Phase B needs to be made longer in order to compensate for the bias introduced in Phase A for certain colors.

Although the invention was described with only two sections in Phase A, those of skill in the art will understand that any reasonable number of sections may be used. However, when top plane switching is employed, the same structure of top plane potentials is fixed no matter which color is to be rendered. According to the invention, the backplane settings corresponding to each top plane potential are varied in Phase A of the waveform according to which color is being rendered, but without violating the condition that the overall waveform, comprising Phases A and B, be DC-balanced.

TABLE 5

| First reset V | Second reset V | Color | L* | a* | b* |
|---|---|---|---|---|---|
| $V_nH$-$V_pH$ | $V_pH$-$V_nH$ | K | 24.67 | 2.68 | −12.53 |
| 0-$V_pH$ | $V_pH$-$V_nH$ | B | 37.99 | 0.41 | −14.78 |
| 0-$V_pH$ | $V_pH$-$V_nH$ | R | 43.7 | 17 | 11.4 |
| 0-$V_pH$ | $V_pH$-$V_nH$ | M | 44.02 | 22.03 | 40.39 |
| $V_nH$-$V_pH$ | 0-$V_nH$ | G | 33.33 | −24.63 | 11.2 |
| $V_nH$-$V_pH$ | 0-$V_nH$ | C | 43.03 | −19.38 | −9.32 |
| $V_nH$-$V_pH$ | 0-$V_nH$ | Y | 67.21 | −9.44 | 59.36 |
| 0-$V_pH$ | $V_pH$-$V_nH$ | W | 70.02 | −0.99 | 6.7 |

DC-balancing the reset pulse can be achieved in the following way:

For a DC-balancing reset process, one set of voltages must be chosen for all transitions in the waveform. Choosing a set of voltages can be problematic because certain palette colors require high voltage, while others require low voltage. For a device with a large amount of simultaneous backplane voltages available, this is not a problem, as each transition can be balanced individually, but in the case of top-plane switching, each transition is coupled together by the top-plane, which forces transitions to be aligned with each other. An additional constraint is enforced by source-driver standards, which currently limit the number of simultaneous backplane voltages to three.

A transition is a sequence of voltages applied to the backplane and top plane, $T_j=(V_B^j, V_T)$, where $V_B^{ij}$ is the backplane voltage for transition j at frame i, and $V_T^i$ is the top plane voltage at frame i. Let $I_u^j=\Sigma_{i=1}^{n_j}(V_B^{ij}-V_T^i)+n_jV_{KB}$ be the total impulse of $T_j$ prior to applying the DC-balancing reset, where $n_j$ is the update length (in frames) of $T_j$, and $V_{KB}$ is the kickback voltage of the display.

Let $\sigma_j$ be the desired DC-balance impulse offset (time*V), $d_r$ be the desired total duration of the DC-balancing reset. The DC-balancing reset has two pulses in it, so top-plane voltages will need to be chosen for each pulse, and backplane voltages will need to be chosen for each pulse and each transition. Let $V_{kp}^j=V_B^{rkj}-V_T^{rk}+V_{KB}$ be the voltage of the $k^{th}$ pulse of transition $T_j$, where $V_B^{rkj}$ is the backplane voltage for the $k^{th}$ reset pulse of transition $T_j$, and $V_T^{rk}$ is the top-plane voltage for the $k^{th}$ reset pulse. It is important that the voltages for the two pulses be chosen so that $V_{1p}^j$ and $V_{2p}^j$ are of opposite signs for each transition.

A "zero" voltage needs to be selected, which would ideally be 0V, although that is not always possible $$V_{kz}^j = V_B^{zkj} - V_T^{rk} + V_{KB}$$

Where $$V_B^{zkj} = \underset{V_B}{\operatorname{argmin}} |V_B - V_T^{rk} + V_{KB}|$$

Next, compute the global maximum duration for each of the two pulses $$\bar{d}_1 = \max_j \frac{d_r V_{2p}^j - \sigma_j}{V_{2p}^j - V_{1p}^j}$$

$$\bar{d}_2 = d_r - \bar{d}_1$$

Then compute the "ideal" duration of each pulse for each transition, which is the duration in the case that $I_u^j=0$. Define the notation $[x]_a^b=\min(b, \max(a, x))$. Then $$d_1^j = \left[\frac{\sigma_j - \bar{d}_1 V_{1z}^j - \bar{d}_2 V_{2p}^j)}{V_{2p}^j - V_{1p}^j}\right]_0^{\bar{d}_1}$$

$$d_2^j = \left[\frac{(\sigma_j - \bar{d}_1 V_{1z}^j - \bar{d}_2 V_{2z}^j - d_1^j (V_{1p}^j - V_{1z}^j))}{V_{2p}^j - V_{2z}^j}\right]_0^{\bar{d}_2}$$

We then break each pulse into an "active" portion and a "zero" portion in order to balance the transition:

$$\gamma_j = \sigma_j - I_u^j - \bar{d}_1 V_{1z}^j - \bar{d}_2 V_{2z}^j$$

$$d_{1p}^j = \left[\frac{\gamma_j - d_2^j (V_{2p}^j - V_{2z}^j)}{V_{1p}^j - V_{1z}^j}\right]_0^{d_1^j}$$

$$d_{2p}^j = \left[\frac{\gamma_j - d_{1p} (V_{1p}^j - V_{1z}^j)}{V_{2p}^j - V_{2z}^j}\right]_0^{d_2^j}$$

$$d_{1z}^j = d_1^j - d_{1p}^j$$

$$d_{2z}^j = d_2^j - d_{2p}^j$$

Figure 9:
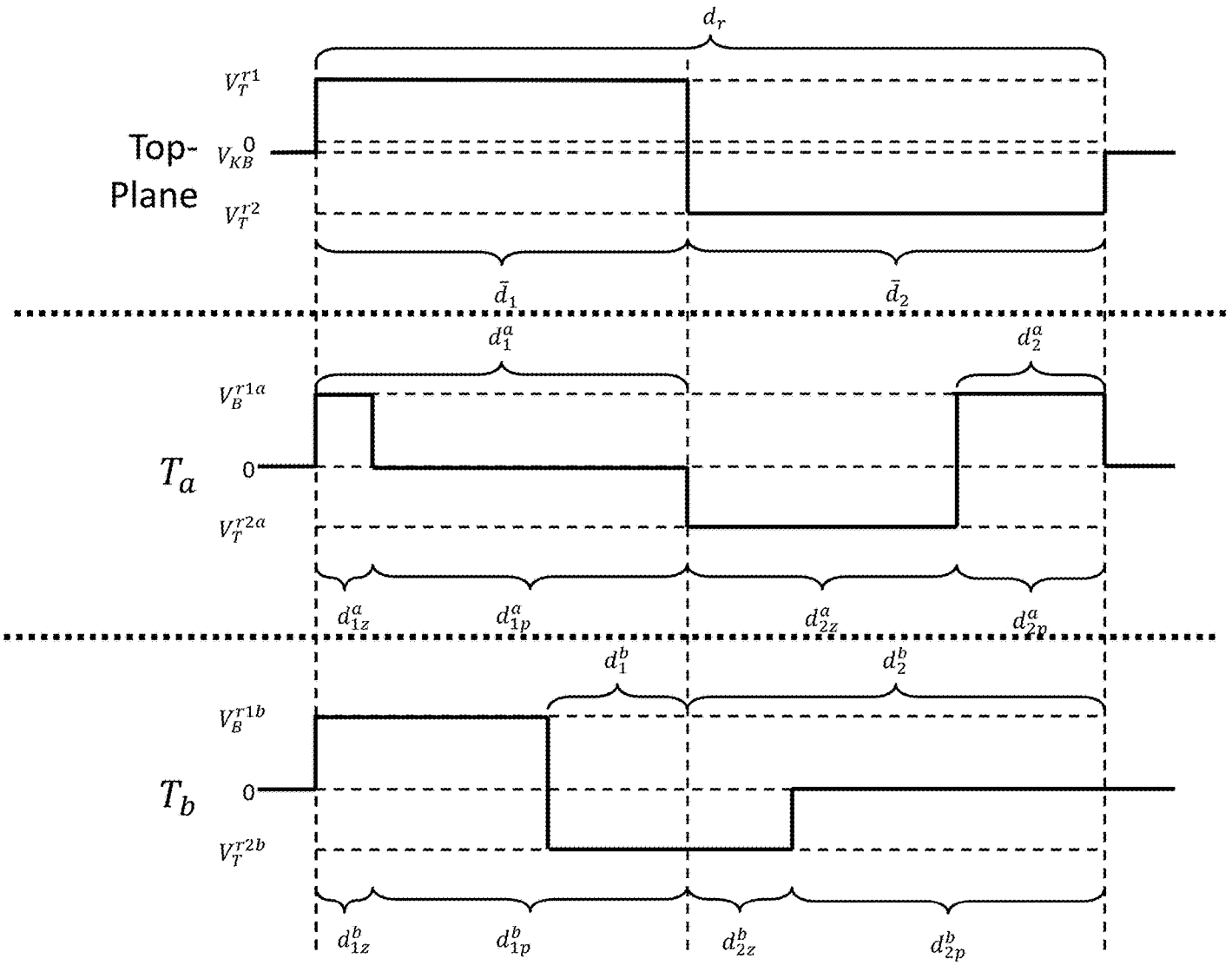
FIG. 9 shows an embodiment of a DC-balanced reset pulse.
Figure 10:
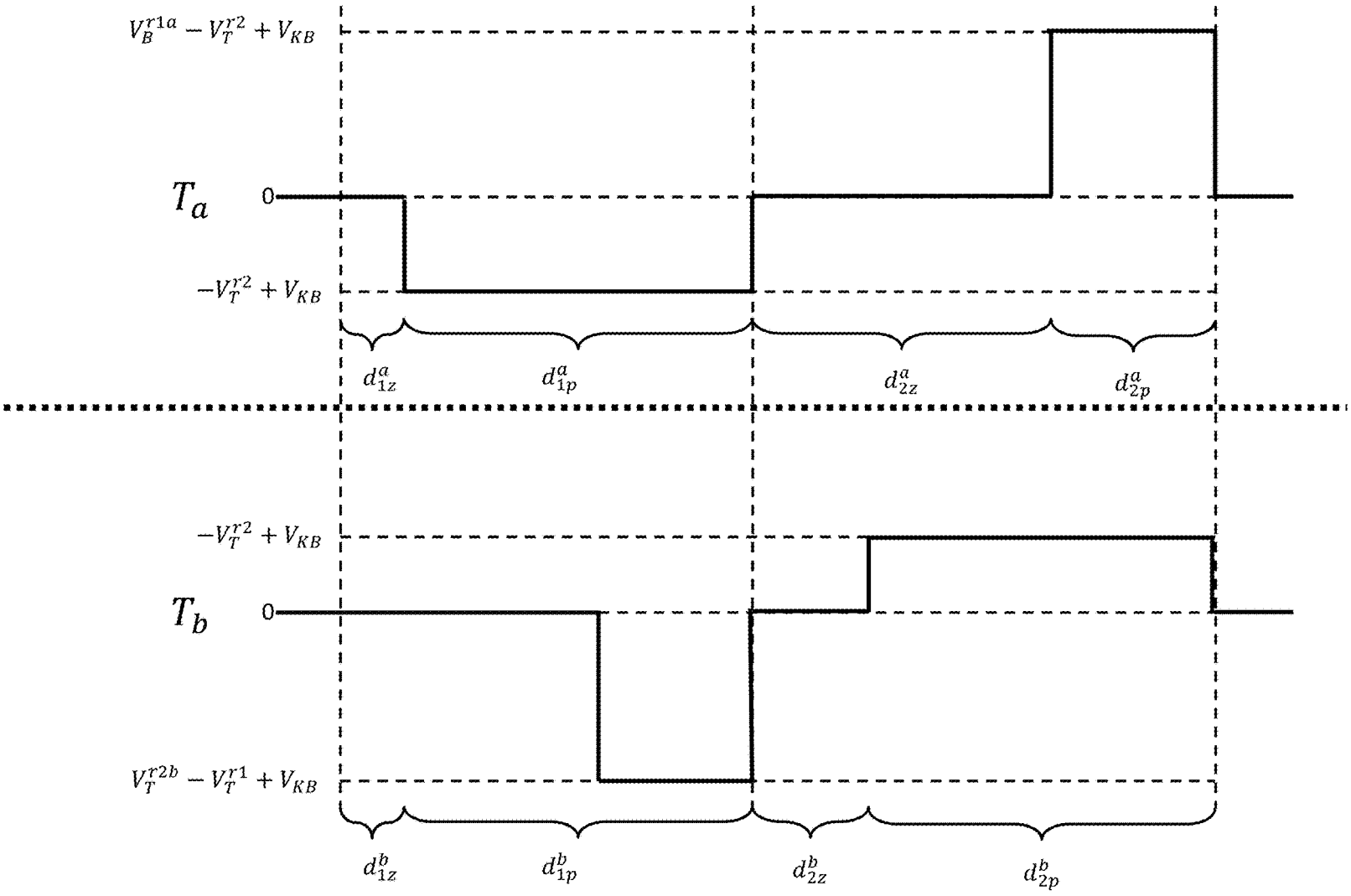
FIG. 10 shows the DC-balanced reset pulse of FIG. 9 as experienced by the electrophoretic particles.

Now we are ready to construct the DC-balancing reset phase of the waveform. The top-plane is driven at $V_T^{r1}$ for duration $\bar{d}_1$, followed by $V_T^{r2}$ for duration $\bar{d}_2$. For each transition $T_j$, we drive at $V_B^{z1j}$ for duration $d_{1z}^j$, followed by $V_B^{r1j}$ for duration $d_{1p}^j$, followed by $V_B^{z2j}$ for duration $d_{2z}^j$, followed by $V_B^{r2j}$ for duration $d_{2p}^j$, as shown in FIG. 9. The resulting waveform that is experienced by the ink is shown in FIG. 10.

At first glance it might appear that the sequential scanning of the various rows of an active matrix display might upset the above calculations designed to ensure accurate DC balancing of waveforms and drive schemes, because when the voltage of the front electrode is changed (typically between successive scans of the active matrix), each pixel of the display will experience an "incorrect" voltage until the scan reaches the relevant pixel and the voltage on its pixel electrode is adjusted to compensate for the change in the front electrode voltage, and the period between the change in front plane voltage and the time when the scan reaches the relevant pixel varies depending upon the row in which the relevant is located. However, further investigation will show that the actual "error" in the impulse applied to the pixel is proportional to the change in front plane voltage times the period between the front plane voltage change and the time the scan reaches the relevant pixel. The latter period is fixed, assuming no change in scan rate, so that for any series of changes in front plane voltage which leaves the final front plane voltage equal to the initial one, the sum total of the "errors" in impulse will be zero, and the overall DC balance of the drive scheme will not be affected.

Thus, the invention provides for DC-balanced waveforms for multi-particle electrophoretic displays. Having thus described several aspects and embodiments of the technology of this application, it is to be appreciated that various alterations, modifications, and improvements will readily occur to those of ordinary skill in the art. Such alterations, modifications, and improvements are intended to be within the spirit and scope of the technology described in the application. For example, those of ordinary skill in the art will readily envision a variety of other means and/or structures for performing the function and/or obtaining the results and/or one or more of the advantages described herein, and each of such variations and/or modifications is deemed to be within the scope of the embodiments described herein. Those skilled in the art will recognize, or be able to ascertain using no more than routine experimentation, many equivalents to the specific embodiments described herein. It is, therefore, to be understood that the foregoing embodiments are presented by way of example only and that, within the scope of the appended claims and equivalents thereto, inventive embodiments may be practiced otherwise than as specifically described. In addition, any combination of two or more features, systems, articles, materials, kits, and/or methods described herein, if such features, systems, articles, materials, kits, and/or methods are not mutually inconsistent, is included within the scope of the present disclosure.

The invention claimed is:

1. A method for driving an electrophoretic display having a front electrode, a backplane, and a display medium positioned between the front electrode and the backplane, the display medium comprising three sets of differently-colored particles, the method comprising:

applying a reset phase and a color transition phase to the display, the reset phase comprising:

applying a first signal having a first polarity, a first amplitude as a function of time, and a first duration on the front electrode;

applying no signal during the first duration on the backplane;

applying a second signal having a second polarity opposite the first polarity, a second amplitude as a function of time, during a second duration on the front electrode; and applying a third signal having the first polarity, and a third amplitude as a function of time, during the second duration on the backplane;

the color transition phase comprising:

applying a fourth signal having the first polarity, a fourth amplitude as a function of time, and a third duration preceded by the first and second durations on the front electrode; and applying a fifth signal having the second polarity, a fifth amplitude as a function of time, and a fourth duration preceded by the first and second durations on the backplane;

wherein the sum of the first amplitude as a function of time integrated over the first duration, and the sum of the second and third amplitudes as a function of time integrated over the second duration, and the fourth amplitude as a function of time integrated over the third duration, and the fifth amplitude as a function of time integrated over the fourth duration produces an impulse offset designed to maintain a DC-balance on the display medium over the reset phase and the color transition phase.

2. The method of claim 1, wherein the fourth duration occurs during the third duration.

3. The method of claim 2, wherein the third duration and the fourth duration initiate at the same time.

4. The method of claim 1, wherein the reset phase erases previous optical properties rendered on the display.

5. The method of claim 1, wherein the color transition phase substantially changes the optical property displayed by the display.

6. The method of claim 1, wherein the first polarity is a negative voltage.

7. The method of claim 1, wherein the first polarity is a positive voltage.

8. The method of claim 1, wherein the impulse offset is proportional to a kickback voltage experienced by the display medium.

9. A controller for an electrophoretic display comprising a front electrode, a backplane, and a display medium positioned between the front electrode and the backplane, the display medium comprising three sets of differently-colored particles, the controller being operatively coupled to the front electrode and the backplane, and configured to apply a reset phase and a color transition phase to the display, the reset phase comprising:

applying a reset phase and a color transition phase to the display, the reset phase comprising:

applying a first signal having a first polarity, a first amplitude as a function of time, and a first duration on the front electrode;

applying no signal during the first duration on the backplane;

applying a second signal having a second polarity opposite the first polarity, a second amplitude as a function of time, during a second duration on the front electrode; and applying a third signal having the first polarity, and a third amplitude as a function of time, during the second duration on the backplane;

the color transition phase comprising:

applying a fourth signal having the first polarity, a fourth amplitude as a function of time, and a third duration preceded by the first and second durations on the front electrode; and applying a fifth signal having the second polarity, a fifth amplitude as a function of time, and a fourth duration preceded by the first and second durations on the backplane;

wherein the sum of the first amplitude as a function of time integrated over the first duration, and the sum of the second and third amplitudes as a function of time integrated over the second duration, and the fourth amplitude as a function of time integrated over the third duration, and the fifth amplitude as a function of time integrated over the fourth duration produces an impulse offset designed to maintain a DC-balance on the display medium over the reset phase and the color transition phase.

10. The controller of claim 9, wherein the controller applies a different reset phase depending upon the color to be displayed by the electrophoretic display.

11. The controller of claim 9, wherein the display medium comprises white, cyan, yellow, and magenta particles.

12. The controller of claim 9, wherein the display medium comprises white, red, blue, and green particles.

13. The controller of claim 9, wherein the reset phase erases previous optical properties rendered on the display.

14. The controller of claim 9, wherein the color transition phase substantially changes the optical property displayed by the display.

15. The controller of claim 9, wherein the impulse offset is proportional to a kickback voltage experienced by the display medium.

* * * * *